US007757970B2

(12) United States Patent
Laidler et al.

(10) Patent No.: US 7,757,970 B2
(45) Date of Patent: Jul. 20, 2010

(54) NOZZLE DEVICES

(75) Inventors: Keith Laidler, Stourbridge (GB); Timothy Rodd, Lindhurst (GB)

(73) Assignee: Incro Limited, West Midlands (GB)

( * ) Notice: Subject to any disclaimer, the term of this patent is extended or adjusted under 35 U.S.C. 154(b) by 0 days.

(21) Appl. No.: 10/545,594

(22) PCT Filed: Feb. 17, 2004

(86) PCT No.: PCT/GB2004/000632

§ 371 (c)(1),
(2), (4) Date: Apr. 18, 2006

(87) PCT Pub. No.: WO2004/073879

PCT Pub. Date: Sep. 2, 2004

(65) Prior Publication Data

US 2006/0231643 A1 Oct. 19, 2006

(30) Foreign Application Priority Data

| | | |
|---|---|---|
| Feb. 18, 2003 | (GB) | 0303698.5 |
| Mar. 12, 2003 | (GB) | 0305597.7 |
| Apr. 17, 2003 | (GB) | 0308909.1 |
| May 3, 2003 | (GB) | 0310244.9 |
| Aug. 1, 2003 | (GB) | 0318022.1 |
| Sep. 4, 2003 | (GB) | 0320720.6 |
| Nov. 25, 2003 | (GB) | 0327423.0 |
| Jan. 15, 2004 | (GB) | 0400858.7 |

(51) Int. Cl.
*B05B 1/30* (2006.01)
*A62C 11/00* (2006.01)

(52) U.S. Cl. ..... 239/569; 239/330; 239/576

(58) Field of Classification Search ..... 239/302, 239/330, 333, 335, 362, 363, 366, 368, 369, 239/461, 337, 349, 463, 589, 590, 576, 569; 222/207, 209, 214, 327

See application file for complete search history.

(56) References Cited

U.S. PATENT DOCUMENTS 3,726,442 A 4/1973 Davidson et al.

(Continued)

FOREIGN PATENT DOCUMENTS

EP 0253577 A2 1/1988

(Continued)

*Primary Examiner*—Davis Hwu
(74) *Attorney, Agent, or Firm*—John H. Pearson, Jr. Esq.; Walter F. Dawson, Esq.; Pearson & Pearson, LLP.

(57) ABSTRACT

This invention relates to pump-action nozzle devices and methods of making the same. The dispenser nozzles of the invention comprises a body which defines an internal chamber having an inlet through which fluid may be drawn into said chamber and an outlet through which fluid present in the chamber may be expelled from the nozzle. The inlet comprises an inlet valve and the outlet comprises an outlet valve. Fluid is dispensed from the dispenser nozzles by pulling the trigger handle of a trigger actuator to resiliently deform or displace a portion of the body of the device that defines the chamber, thereby compressing the chamber and actuating the dispensing of fluid. In preferred embodiments, the outlet comprises an outlet passageway that extends from the chamber to an outlet orifice. One or more spray-modifying features are preferably formed within the outlet passageway.

51 Claims, 18 Drawing Sheets

U.S. PATENT DOCUMENTS

| | | | | | |
|---|---|---|---|---|---|
| 3,762,442 | A | | 10/1973 | Paul | |
| 3,820,689 | A | | 6/1974 | Cocita | |
| 4,182,465 | A | | 1/1980 | Bennett | |
| 4,489,861 | A | | 12/1984 | Saito et al. | |
| 5,303,851 | A | | 4/1994 | Libit | |
| 5,439,178 | A | * | 8/1995 | Peterson | 239/333 |
| 5,462,208 | A | * | 10/1995 | Stahley et al. | 222/207 |
| 5,884,845 | A | | 3/1999 | Nelson | |
| 5,894,960 | A | | 4/1999 | Rodden, Jr. et al. | |
| 5,964,377 | A | * | 10/1999 | Demarest et al. | 222/136 |
| 2002/0074359 | A1 | | 6/2002 | Weber | |

FOREIGN PATENT DOCUMENTS

| | | | |
|---|---|---|---|
| EP | 0274873 | A1 | 7/1988 |
| EP | 0442858 | A2 | 8/1991 |
| EP | 0649684 | A2 | 4/1995 |
| FR | 2127774 | | 10/1972 |
| WO | WO01/89958 | | 11/2001 |
| WO | WO03/049916 | A1 | 6/2003 |

* cited by examiner

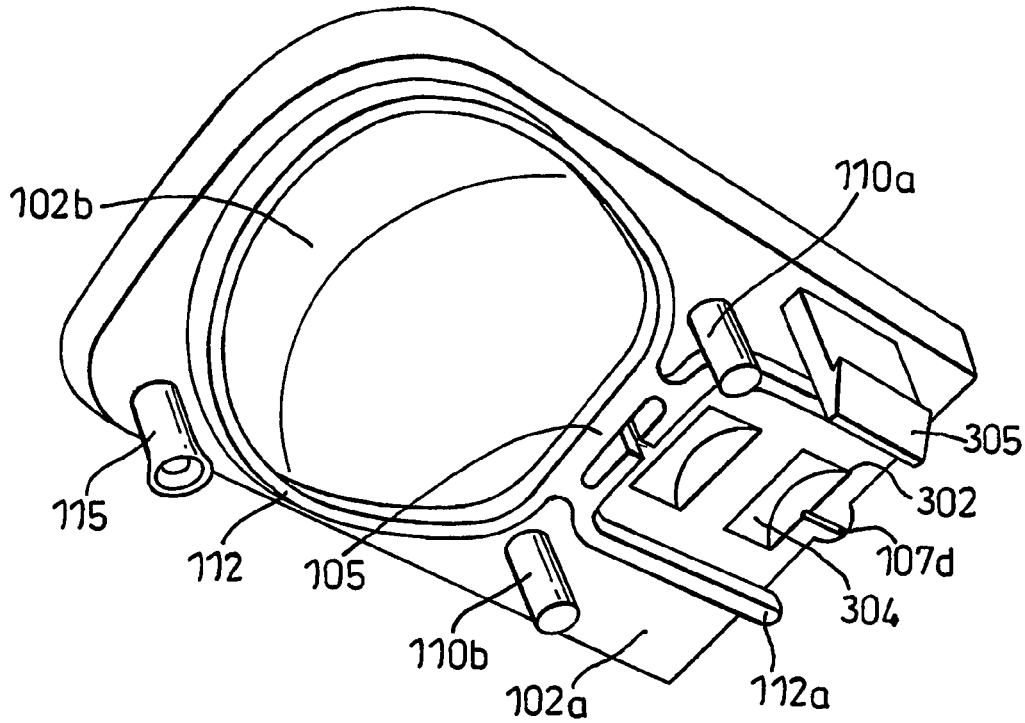
*Fig. 3*
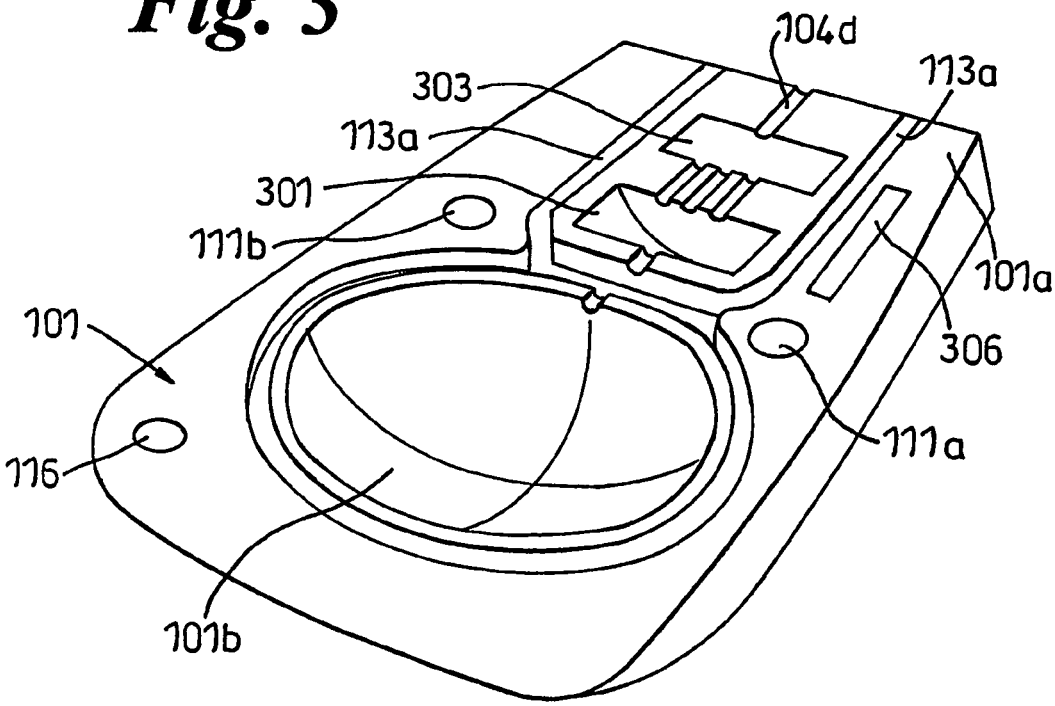

NOZZLE DEVICES

This invention relates to an actuator for nozzle devices and, more particularly but not exclusively, to trigger-actuated nozzle devices and methods of making such devices.

Trigger-actuated nozzle devices are commonly used to provide a means by which fluids can be dispensed from a non-pressurised container.

However, one problem with conventional trigger-actuated nozzle devices is that they tend to be extremely complex in design and typically comprise numerous component parts (usually between 10 and 14 individual components). As a consequence, these devices can be costly to manufacture due to the amount of material required to form the individual components and the assembly processes involved.

Therefore, there is a desire for a trigger-actuated nozzle device, which is:

(i) simple in design;

(ii) utilises less components; and (iii) easy to actuate.

The present invention provides a solution to the problems associated with conventional trigger-actuated nozzle devices by providing, in a first aspect, a pump-action nozzle device configured to enable fluid to be dispensed from a container, said nozzle having a body which defines an internal chamber having an inlet through which fluid may be drawn into said chamber and an outlet through which fluid present in the chamber may be expelled from the nozzle, said inlet comprising an inlet valve adapted to only permit fluid to flow into the chamber through the inlet when the pressure within the chamber falls below the pressure within the interior of the container to which the device is attached by at least a predetermined minimum threshold amount and said outlet comprising an outlet valve configured to only permit fluid to flow out of the chamber and be expelled from the nozzle when the pressure within the chamber exceeds the external pressure at the outlet by at least a predetermined threshold amount, wherein at least a portion of the body which defines said chamber is configured to:

(i) resiliently deform from an initial resiliently biased configuration to a distended or deformed configuration in response to the application of a pressure, whereby the volume of said chamber defined by said portion of the body is reduced as said portion of the body is deformed from said initial configuration to said distended or deformed configuration, said reduction in volume causing the pressure within the chamber to increase and fluid to be ejected through the outlet; and (ii) subsequently return to its initial resiliently biased configuration when the applied pressure is removed, thereby causing the volume of the chamber to increase and the pressure therein to fall such that fluid is drawn into the chamber through the inlet valve;

characterised in that said nozzle device further comprises a trigger actuator, said trigger actuator comprising a trigger handle that can be pulled by an operator and an engagement portion configured to engage said portion of the body and cause it to deform from its resiliently biased position when said trigger handle is pulled.

The nozzle device of the present invention solves the aforementioned problems associated with many conventional pump-action spray nozzle devices by providing a device which is extremely simple in design and which will typically comprise no more than six separate component parts that are fitted together to form the assembled nozzle device. In preferred embodiments the device will comprise no more than three component parts or, more preferably, two separate component parts or, even more preferably, the device is formed from a single, integrally formed component. By "separate component parts" we mean that the parts are not linked in any way, i.e. they are not integrally formed with one another (but each separate component part may comprise one or more integral parts or portions). The key to reducing the number of components lies in the formation of the necessary features integrally within the body of the device. For instance, the chamber, inlet, inlet valve, outlet, and outlet valve can all be defined by the body, thereby reducing the need to include separate components with all the consequential increases in component and assembly costs.

The nozzle device of the present invention is further adapted to solve the problems associated with the pump-action nozzle devices described in EP 0 442 858 A2 and U.S. Pat. No. 3,820,689 and EP 0 649 684 by providing a trigger actuator that can be conveniently pulled to actuate the dispensing of fluid from the chamber of the device.

The trigger actuator is adapted so that when an operator pulls the trigger, a portion of the engagement portion engages the resiliently deformable portion of the body and causes it to resiliently deform, thereby compressing the chamber and causing fluid present in the chamber to be expelled through the outlet of the device.

The trigger actuator may be a separate component, which can be connected to the nozzle device. Preferably, however, the trigger is integrally formed with the nozzle device. It is also preferable that the handle of the trigger actuator extends below the outlet in a similar manner to conventional trigger nozzle devices, i.e. enabling an operator to grip the nozzle device, point the outlet in the desired direction and dispense fluid by pulling the trigger actuator towards the base of the nozzle device.

Preferably, the trigger actuator is pivotally mounted to the body of the nozzle device such that pulling the trigger handle causes the engagement portion to pivot and apply pressure to the resiliently deformable portion of the body of the nozzle device. When the trigger handle is released, the resilience of the resiliently deformable portion of the body of the nozzle device urges the trigger back to its initial "non-actuated" configuration. Alternatively and/or in addition, the trigger may be spring loaded to enable it to return to its initial non-actuated configuration.

The pivotal connection may be formed at any suitable position. For example, the pivot may be provided at an edge of the upper surface (e.g. a front or back edge), or more preferably, the pivotal connection may be on the upper surface at a position, which is displaced from an edge of the device, for example, at or near to the middle of the upper surface of the device. This latter positioning of the pivotal connection has been found to provide a more natural or "familiar" feel to an operator when the trigger is pulled.

To provide the necessary resilience to the resiliently deformable portion of the chamber, it may be thickened and/or include strengthening ribs that extend across the resiliently deformable body portion.

The trigger actuator may also be partially or totally over moulded with a flexible plastic to provide a softer contact surface and thus, increase the comfort for the operator when it is grasped. Over-moulding with a flexible plastic can also be applied to the back hinge to strengthen it if desired.

In certain embodiments of the invention, an additional chamber having a resiliently deformable wall is present between the hinged member and the resiliently deformable portion of the body so that pressing the free end of the hinged member towards the nozzle device also causes the additional chamber to be compressed and the contents stored therein to be expelled. The additional chamber is preferably adapted to contain air and comprises an outlet valve and an inlet valve as hereinbefore defined. The air expelled from the additional chamber may be directed into the outlet passageway to mix with fluid ejected from the first or main chamber of the nozzle device. Alternatively, the air stream may mix with the spray droplets at the outlet, i.e. outside of the nozzle device. Preferably, that outlet valve of the air chamber has a lower minimum threshold pressure at which the outlet opens than the outlet valve of the first or main chamber of the nozzle device. This enables the air stream to start flowing before the fluid stream from the main chamber and to continue after the expulsion of the contents of the main chamber has finished. This ensures that an air stream is always available for mixing with, and atomising the spray droplets.

In certain embodiments of the invention the outlet of the nozzle device may be adapted to generate a spray of the fluid ejected from the chamber of the nozzle device. The outlet of the nozzle device may be adapted to perform this function by any suitable means known in the art. For instance, the outlet orifice of the outlet may be a fine hole configured such that fluid flowing through it under pressure is caused to break up into numerous droplets. In such embodiments, however, it is preferable that the outlet comprises an outlet orifice and an outlet passageway that connects the chamber to the outlet orifice. The outlet valve is preferably disposed within the outlet passageway. It is especially preferred that the outlet passageway comprises one or more internal spray-modifying features that are adapted to reduce the size of liquid droplets dispensed through the outlet orifice of the nozzle device during use. Examples of internal spray modifying features that may be present in the outlet passageway include one or more expansion chambers, one or more swirl chambers, one or more internal spray orifices (adapted to generate a spray of fluid flowing through within the outlet passageway), and one or more venturi chambers. The inclusion of one or more of the aforementioned features is known to affect the size of the spray droplets produced during use of the device. It is believed that these features, either alone or in combination, contribute to the atomisation of the droplets generated. These spray-modifying features, and the effect that they impart on the properties of the spray produced, are known in the art and are described in, for example, International Patent Publication Number WO 01/89958, the entire contents of which are incorporated herein by reference. It shall be appreciated that the provision of the outlet valve upstream from the outlet passageway and the outlet orifice ensures that the fluid enters the outlet passageway with sufficient force for the liquid to be broken up into droplets and form a spray.

In certain embodiments of the invention, the outlet passageway and outlet orifice may be in the form of a separate unit or insert, which can be connected to the outlet of the chamber to form the outlet of the nozzle device. The unit or insert may also be connected to the body of the device by a hinge so as to enable it to be optionally swung into the required position for use and swing out of position when it is not required.

In alternative embodiments of the invention, the liquid present in the chamber may be dispensed as a stream of liquid which is not broken up into droplets. Examples of such liquids dispensed in this form include soaps, shampoos, creams and the like.

Alternatively, the fluid dispensed may be a gas or mixture of gasses, such as air, for example.

The Body of the Nozzle Device

The chamber defined by the body may be defined between two or more interconnected parts of the body. It is especially preferred that the chamber of the nozzle device is defined between two interconnected parts, which may be separately formed component parts that fit together to define the chamber or, more preferably, the two parts will be integrally formed with one another as a single component. In the latter case, it is preferred that the two parts are connected together by hinge or foldable connection element which enables the two parts to be moulded together in the same mould and then brought into contact with one another to define the chamber.

In preferred embodiments of the invention in which the outlet comprises the outlet valve, an outlet orifice and an outlet passageway that connects the outlet valve to the outlet orifice, it is also preferred that the at least two interconnected parts that define the chamber also define at least a portion of the outlet passageway. Most preferably, the two interconnected parts form the outlet valve between them and also define the entire outlet passageway and the outlet orifice.

The outlet passageway is preferably defined between an abutment surface of one of said parts and an opposing abutment surface of another of said parts. One or more of the abutment surfaces preferably comprises one or more grooves and/or recesses formed thereon which define the outlet passageway when the abutment surfaces are contacted together. Most preferably, each of said abutment surfaces comprises a groove and/or recesses formed thereon which align to define the outlet passageway when the abutment surfaces are contacted together. The grooves and/or recesses preferably extend from the chamber to an opposing edge of the abutment surfaces where, when the abutment surfaces are contacted together, an outlet orifice is defined at the end of the outlet passageway. In preferred embodiments where one or more spray modifying features are present in the outlet passageway, the features may be formed by aligning recesses or other formation formed on the abutment surfaces, as illustrated and described in International Patent Publication Number WO 01/89958.

The two parts of the body may be permanently fixed together by, for example, ultrasonically welding or heat welding. If the base and upper part are to be moulded or welded together, then it is preferable that they are made from compatible materials. As previously indicated above, however, it is preferable that the body if formed from a single material.

Alternatively, the two parts may be configured to fit tightly/resistively to one another to form the nozzle (e.g. by the provision of a snap-fit connection) in the absence of any welding. For instance, the edges of one part may be configured to fit into a retaining groove of the other part to form the nozzle device.

As a further alternative, a compatible plastic material may be moulded over the join of the two parts to secure them together. This can be achieved by moulding the two components simultaneously in a tool, joining them together in the tool to form the dispenser nozzle device and then moulding a suitable plastic material around them to hold the two parts together.

In certain embodiments, the two parts may remain releasably attached to one another so that they can be separated during use to enable the chamber and/or the outlet to be cleaned.

It is most preferred that the two parts of the body of the nozzle device that define the chamber are a base part and an upper part. The base part is preferably adapted to be fitted to the opening of a container by a suitable means, such as, for example, a screw thread or snap fit connection. Furthermore, in addition to forming a portion of the body that defines the chamber, the base part also preferably defines the inlet as well as a portion of the outlet passageway leading from the chamber to the outlet orifice in preferred embodiments.

The upper part is adapted to be fitted to the base so that between them they define the chamber and, in preferred embodiments, the outlet valve, outlet passageway and/or outlet orifice. In certain preferred embodiments of the invention, the base and upper part also define the outlet orifice. It is also preferred that the upper part forms the resiliently deformable portion of the body defining the chamber.

As previously mentioned above, the trigger actuator member may be a separate component part that is fitted to the body of the nozzle device once it has been assembled. Preferably, however, the trigger actuator is integrally formed with one of the component parts of the body. Most preferably, the trigger actuator is integrally formed and connected to one of said parts by hinge or foldable connection element.

Two or More Chambers

The nozzle device of the invention may comprise two or more separate internal chambers.

Each individual chamber may draw fluid into the nozzle device through a separate inlet from different fluid sources, e.g. separate fluid-filled compartments within the same container.

Alternatively, one or more of the additional chambers may not comprise an inlet. Instead a reservoir of the second fluid may be stored in the chamber itself and the additional chamber or its outlet may be configured to only permit a predetermined amount of the second fluid to be dispensed with each actuation.

As a further alternative, one or more chambers of the additional chambers may draw air in from outside the nozzle device. Whether the additional chamber or chambers contain air or some other fluid drawn from a separate compartment within the container, the contents of the two or more chambers can be ejected simultaneously through the outlet by simultaneously compressing both chambers together. The contents of the respective chambers will then be mixed within the outlet, either on, after or prior to, ejection from the nozzle device. It shall be appreciated that varying the relative volumes of the separate chambers and/or the dimensions of the outlet can be used to influence the relative proportions of constituents present in the final mixture expelled through the outlet. Furthermore, the outlet passageway may be divided into two or more separate channels, each channel extending from a separate chamber, and each separate channel may feed fluid into a spray nozzle passageway as discussed above where it is mixed prior to ejection.

Where an additional chamber for the expulsion of air is present, it shall be appreciated that, once the expulsion of air is complete and the applied pressure is removed thereby allowing the chamber to deform back to its original expanded configuration, more air needs to be drawn into the chamber to replenish that expelled. This can be achieved by either sucking air back in through the outlet (i.e. not providing this additional chamber with an airtight outlet valve) or, more preferably, drawing air in though an inlet hole in the body defining the chamber. In the latter case, the inlet hole is preferably provided with a one-way valve similar to the inlet valve discussed above. This valve will only permit air to be drawn into the chamber and will prevent air being expelled back through the hole when the chamber is compressed.

In most cases, it is desirable to co-eject the air and fluid from the container at approximately the same pressure. This will require the air chamber to be compressed more (e.g. 3-200 times more—depending on the application concerned) than the fluid/liquid-containing chamber. This may be achieved by positioning the chambers so that, when a pressure is applied, the compression of the air-containing chamber occurs preferentially, thereby enabling the air and liquid to be ejected at the same or substantially the same pressure. For example, the air-containing chamber may be positioned behind the liquid-containing chamber so that, when a pressure is applied, the air chamber is compressed first until a stage is reached when both chambers are compressed together.

As an alternative, the nozzle device may also be adapted in such a way that the air pressure may be higher or lower than the liquid pressure, which may be beneficial for certain applications.

The chambers may be arranged side by side or one chamber may be on top of another. In a preferred embodiment where one of the additional chambers contains air, the additional air chamber is positioned relative to the chamber of the nozzle device so that the compression of the air chamber causes the resiliently deformable portion of the body to deform and compress the chamber of the nozzle device.

Preferably, the fluid present in each chamber are ejected simultaneously. However, it shall be appreciated that one chamber may eject its fluid before or after another chamber in certain applications.

In alternative embodiments, air and fluid from the container may be present in a single chamber, rather than separate chambers. In such cases, fluid and air is co-ejected and may be mixed as it flows through the outlet. For example, where the outlet comprises an expansion chamber, i.e. a widened chamber positioned in the outlet passageway, the contents ejected from the chamber could be split into separate branches of the channel and enter the expansion chamber at different locations to encourage mixing.

Material

The body of the nozzle arrangement may be made from any suitable material.

In preferred embodiments where the body comprises two interconnected parts, which fit together to define the chamber, the two parts may be made from either the same or different materials. For instance, one of the parts may be made from a flexible/resiliently deformable material, such as a resiliently deformable plastic or rubber material, and the other of said parts may be made from a rigid material, such as a rigid plastic. Such embodiments are preferred for some applications because the flexible/resiliently deformable material forms the resiliently deformable portion of the body defining the chamber and can readily be depressed by an operator to actuate the ejection of fluid present in the chamber in the form of a spray. The flexible material can also provide a soft touch feel for the operator. Preferably, the base part will be formed from a rigid plastic and the upper part will be formed from a resiliently deformable material. Such embodiments can be made by either moulding the two parts separately and then connecting them together to form the assembled nozzle arrangement, or moulding the two parts in the same tool using a bi-injection moulding process. In the latter case, the two parts could be moulded simultaneously and then fitted together within the moulding tool or, alternatively, one part could be moulded first from a first material and the second part made from a second material could be moulded directly onto the first part.

Alternatively, the two parts may both be made from either a rigid or a flexible material. The rigid and flexible material may be any suitable material from which the nozzle device may be formed. For instance, it may be formed from metallic material such as aluminium foil or a flexible material such as rubber. Preferably, however, the body of the device is formed entirely from a rigid plastic material or a flexible plastic material.

The trigger actuator may be formed from any suitable material. Preferably it is formed from a rigid plastic material.

The entire pump-action nozzle device (i.e. the body and the actuator) is preferably formed from a single rigid or flexible plastic material.

The expression "rigid plastic material" is used herein to refer to a plastic material that possesses a high degree of rigidity and strength once moulded into the desired form, but which can also be rendered more flexible or resiliently deformable in portions by reducing the thickness of the plastic. Thus, a thinned section of plastic can be provided to form the at least a portion of the body that defines the chamber and which is configured to resiliently deform.

The term "flexible plastic" is used herein to denote plastics materials, which are inherently flexible/resiliently deformable so as to enable the resilient displacement of at least a portion of the body to facilitate the compression of the chamber. The extent of the flexibility of the plastic may be dependent on the thickness of the plastic in any given area or region. Such "flexible plastic" materials are used, for example, in the preparation of shampoo bottles or shower gel containers. In the fabrication of a nozzle device of the present invention, portions of the body may be formed from thicker sections of plastic to provide the required rigidity to the structure, whereas other portions may be composed of thinner sections of plastic to provide the necessary deformability characteristics. If necessary, a framework of thicker sections, generally known as support ribs, may be present if extra rigidity is required in certain areas.

Forming the entire body of the device from a single material enables the entire nozzle device to be moulded in a single moulding tool and in a single moulding operation, as discussed further below.

The formation of the nozzle device from a single material, particularly in preferred embodiments where the two parts are integrally formed and connected to one another by a foldable connection element or a hinged joint so that the upper part can be swung into contact with the base part to form the assembled nozzle device, avoids the requirement for the assembly of multiple, separate component parts. Furthermore, forming the nozzle device from a single material provides the possibility of welding the two parts together (e.g. by heat or ultrasonic welding) or, if the plastic material is a rigid plastic material, then a snap-fit connection can be formed between the upper part and the base. The latter option also enables the upper part and base to be disconnected periodically for cleaning.

For most applications the nozzle device would need to be made from a rigid material to provide the necessary strength and enable the two-parts to be either snap fitted or welded together. In such cases, the deformable portion of the body tends to deform only when a certain minimum threshold pressure is applied and this makes the pump action more like the on/off action associated conventional pump-action nozzle devices. However, in certain applications, a flexible material may be preferred.

The portion of the body configured to resiliently deform could be a relatively thin section of a rigid plastic material, which elastically deforms to compress the chamber when a pressure is applied and then subsequently returns to its initial resiliently biased configuration when the applied pressure is removed. Alternatively, the portion of the body concerned may comprise a substantially rigid portion surrounded by a deformable portion such that pressure applied to the rigid portion causes the surrounding resiliently deformable portion to deform and thereby enables the rigid portion to be displaced to compress the chamber. For example, the surrounding resiliently deformable portion could resemble a bellows, i.e. a rigid portion is surrounded by a deformable side wall that comprises a number of folded segments of rigid plastic which is configured such that applying a pressure to the rigid portion causes the folds of the sidewall to resiliently compress together to reduce the volume of the chamber. Once the applied pressure is removed, the side walls return to their original configuration.

In most cases, however, it is preferable that the abutment surfaces that define the outlet passageway of the outlet are formed from a rigid plastic material. Although flexible/resiliently deformable materials could be used for this purpose they are generally less preferred because any spray-modifying features present will typically need to be precisely formed from a rigid material. Thus, in some embodiments of the invention, one of the two parts that defines the outlet and the chamber may be formed from two materials, namely a rigid material that forms the abutment surface that defines the outlet passageway and the outlet orifice, and a resiliently deformable material that defines the chamber.

Outlet Valve

In order to function optimally, it is necessary that the outlet of the chamber is provided with, or is adapted to function as, a one-way valve. The one-way valve enables product stored in the chamber to be dispensed through the outlet only when a predetermined minimum threshold pressure is achieved within the chamber (as a consequence of the reduction in the volume of the internal chamber caused by the displacement of the resiliently deformable wall from its initial resiliently biased configuration), and closes the outlet at all other times to form an airtight seal. The closure of the valve when the pressure in the chamber is below a predetermined minimum threshold pressure prevents air being sucked back through the outlet into the chamber when the applied pressure to the resiliently deformable portion of the body is released and the volume of the chamber increases as the resiliently deformable wall re-assumes its initial resiliently biased configuration.

Any suitable one-way valve assembly that is capable of forming an airtight seal may be provided in the outlet. However, it is preferable that the valve is formed by the component parts of the body of the nozzle device. Most preferably, the valve is formed between the abutment surfaces that define outlet passageway.

In certain embodiments of the invention, the outlet valve is formed by one of the abutment surfaces being resiliently biased against the opposing abutment surface to close off a portion of the length of the outlet passageway. In this regard, the valve will only open to permit fluid to be dispensed from the chamber when the pressure within the chamber is sufficient to cause the resiliently biased abutment surface to deform away from the opposing abutment surface and thereby form an open channel through which fluid from the chamber can flow. Once the pressure falls below a predetermined minimum threshold value, the resiliently biased surface will return to its resiliently biased configuration and close off the passageway.

In certain embodiments of the invention, it is especially preferred that the resiliently biased abutment surface is integrally formed with the resiliently deformable portion of the body, which defines the chamber.

In embodiments where the body is made entirely from a rigid plastic material, the resistance provided by the resiliently biased surface, which will be a thin section of rigid plastic) may not be sufficiently resilient to achieve the required minimum pressure threshold for the optimal functioning of the device. In such cases, a thickened rib of plastic, which extends across the passageway, may be formed to provide the necessary strength and resistance in the outlet passageway/valve. Alternatively, a rigid reinforcing rib could be provided above part of the outlet passageway/valve.

In an alternative preferred embodiment, the outlet/pre-compression valve is formed by a resiliently deformable member formed on one of said abutment surfaces which extends across the outlet passageway to close off and seal the passageway. The member is mounted to the device along one of its edges and has another of its edges (preferably the opposing edge) free, the free end being configured to displace when the pressure within the chamber exceeds a predetermined minimum threshold value. The free end abuts a surface of the outlet channel to form a seal therewith when the pressure is below the predetermined minimum threshold value. However, when the pressure exceeds the predetermined minimum threshold value, the free end of the member is displaced from the abutment surface of the channel to form an opening through which the fluid present in the chamber can flow to the outlet. Preferably, the resiliently deformable member is positioned within a chamber formed along the length of the outlet channel or passageway. Most preferably, the abutment surface, which forms the seal with the free end of the member at pressures below the minimum threshold, is tapered or sloped at the point of contact with the free end of the member. This provides a point seal contact and provides a much more efficient seal. It will of course be appreciated that the slope or taper of the abutment surface must be arranged so that the free end of the resiliently deformable member contacts the slope when the pressure within the chamber is below the predetermined minimum threshold, but distends away from it when the predetermined minimum threshold is exceeded.

Alternatively, the valve may be a post or plug formed on the abutment surface of one of the base or upper parts and which contacts the opposing abutment surface to close off and seal the passageway. The post or plug will be mounted to a deformable area of the base or upper part so that when the pressure within the chamber exceeds a predetermined threshold value, the post or plug can be deformed to define an opening through which fluid can flow through the outlet.

The predetermined minimum pressure that must be achieved within the chamber in order to open the outlet valve will depend on the application concerned. A person skilled in the art will appreciate how to modify the properties of the resiliently deformable surface by, for example, the selection of an appropriate resiliently deformable material or varying the manner in which the surface is fabricated (e.g. by the inclusion of strengthening ridges).

Inlet Valve

To ensure that fluid is only ejected through outlet when the chamber is compressed by displacing the resiliently deformable portion of the body into the chamber from its initial resiliently biased configuration, it is necessary to provide a one-way inlet valve disposed at or in the inlet of the nozzle device.

Any suitable inlet valve may be used.

The inlet valve may be adapted to only open and permit fluid to flow into the chamber when the pressure within the chamber falls below a predetermined minimum threshold pressure (as is the case when the pressure applied to the resiliently deformable portion of the chamber to compress the chamber is released and the volume of the chamber increases as the resiliently deformable portion reassumes it's initial resiliently biased configuration). In such cases, the inlet valve may be a flap valve which consists of a resiliently deformable flap positioned over the inlet opening. The flap is preferably resiliently biased against the inlet opening and adapted to deform so as to allow fluid to be drawn into the chamber through the inlet when the pressure within the chamber falls below a predetermined minimum threshold pressure. At all other times, however, the inlet will be closed, thereby preventing fluid flowing back from the chamber into the inlet. It is especially preferred that the resiliently deformable flap is formed as an integral extension of the resiliently deformable portion of the body which defines the chamber. It is also especially preferred that the base defines the inlet and the resiliently deformable portion of the body is formed by the upper part. It is therefore preferred that the upper part comprises the resiliently deformable flap that extends within said chamber to cover the inlet opening to the chamber and form the inlet valve.

Alternatively, the flap may not be resiliently biased against the inlet opening and may instead be disposed over the inlet opening and configured such that it is pressed against the inlet only when the chamber is compressed and the pressure therein increases.

Problems can arise, however, with the simple provision of a flap valve that is resiliently biased over the inlet opening. Specifically, over time the elastic limit of the material from which the flap is formed may be exceeded, which may cause it to not function properly. This problem applies particularly to embodiments of the invention in which the flap is formed from a thin section of a rigid material, although it also applies to a lesser extent to flexible materials and can occur due to deformation of the flap when the chamber is compressed, as well as when the flap deforms to open the valve. As a consequence, fluid could leak from the chamber back into the container through the inlet.

For these reasons it is preferable that the flap valve comprises a number of adaptations. In particular, it is preferred that the inlet has a raised lip extending around the inlet orifice that the resiliently deformable flap abuts to create a tight seal around the inlet. The provision of a lip ensures a good contact is obtained with the flap. In embodiments where the lip is very small it may be necessary to provide one or more additional support ribs at either side of the inlet opening to ensure that a proper seal is formed and to also prevent the lip from damage.

A further preferred feature is that the flap possesses a protrusion or plug formed on its surface. The protrusion or plug extends a short way into the inlet opening and abuts the side edges to further enhance the seal formed.

It is also preferred that the inlet opening to the chamber is disposed at an elevated position within the chamber so that fluid flows into the chamber through the inlet and drops down into a holding or reservoir area. This prevents fluid resting on the top of the inlet valve over prolonged periods by effectively distancing the inlet opening from the main fluid holding/reservoir area of the chamber and thereby reduces the likelihood of any leaks occurring over time.

It is also preferred that a second reinforcing flap or member contacts the opposing surface of the resiliently deformable flap to urge it into tight abutment with the inlet opening. It is also preferred that the second reinforcing flap contact the opposing surface of the resiliently deformable flap at or close to the portion of the opposing surface that covers the inlet orifice to maximise the vertical pressure of the main flap over the hole. Again this helps to maintain the integrity of the seal.

Lock

The nozzle device may also be provided with a locking means to prevent the fluid being dispensed accidentally.

In such embodiments the lock will be integral part of the body and will not be a separate component connected to the body. For instance, the locking means may be hinged bar or member that is integrally connected to a part of the body (e.g.

either the base or upper part) and which can be swung into a position whereby the bar or member prevents the outlet valve from opening.

Alternatively, the locking means may be incorporated into the trigger actuator. For instance, one or more locking tabs may be provided which can be selectively positioned between the body of the device and the trigger handle to prevent the trigger being pulled. The tabs must be removed from engagement with the trigger and/or body of the device to enable the device to be used. For example, the tables may need to be pressed inward to release the locking tabs. To make the lock childproof, it could also be modified so that it is necessary to initially push the trigger away from the device in order to release the lock.

Air Release/Leak Valve

The device may further comprise an air leak through which air can flow to equalise any pressure differential between the interior of the container and the external environment. In some cases, the air leak may simply occur through gaps in the fitting between the dispenser nozzle and the container, but this is not preferred because leakage may occur if the container is inverted or shaken. In preferred embodiments, the dispenser nozzle further comprises an air leak valve, i.e. a one-way valve that is adapted to permit air to flow into the container, but prevents any fluid leaking out of the container if it is inverted. Any suitable one-way valve system would suffice. It is preferred, however, that the air leak valve is integrally formed within the body of the dispenser or, more preferably, between two component parts of the body of the dispenser.

Most preferably, the air leak valve is formed between the upper part and base which define the chamber of the dispenser nozzle.

Preferably, the air leak valve comprises a valve member disposed within a channel that is defined by the body of the device and connects the interior of the fluid supply to the external environment. Most preferably, the valve member is resiliently biased so as to contact the sides of the channel and forms a sealing engagement therewith to prevent any liquid from leaking out of the container, the valve member being further adapted to either resiliently deform or displace from the sealing engagement with the sides of the channel to define an opening through which air can flow into the container when pressure within the container falls below the external pressure by at least a minimum threshold amount. Once the pressure differential between the interior and the exterior of the container has been reduced to below the minimum threshold pressure, the valve member returns to it position in which the channel is closed.

Preferably, the valve member is in the form of a plunger that extends into the channel and comprises an outwardly extending wall that abuts the sides of the channel to form a seal. Preferably, the outwardly extending wall is additionally angled towards the interior of the container. This configuration means that a high pressure within the container and exerted on the wall of the valve member will cause the wall to remain in abutment with the sides of the channel. Thus, the integrity of the seal is maintained thereby preventing liquid from leaking out through the valve. Conversely, when pressure within the container falls below the external pressure by at least a minimum threshold amount, the wall is deflected away from the sides of the container to permit air to flow into the container to equalise or reduce the pressure differential.

It is especially preferred that the plunger is mounted on to a deformable base or flap which is capable of some movement when the dome is pressed to displace any residue that may have accumulated in the air leak valve. In addition, the provision of a moveable (e.g. resiliently deformable) element within the air leak valve is preferred because it helps to prevent the valve becoming clogged during use.

In certain embodiments of the invention it is also preferred that a protective cover is provided over the opening of the female tube on the internal surface of the device to prevent liquid present in the interior of the container from contacting the valve member with a high or excessive force when the container is inverted or shaken aggressively. The cover will allow air and some fluid to flow past, but will prevent fluid impacting on the seal formed by the flared end of the plunger directly, and thus will prevent the seal being exposed to excessive forces.

In an alternative embodiment, the channel of the air leak valve may be resiliently deformable instead of the male part. This arrangement can be configured so that the side walls of the channel distort to permit air to flow into the container.

The valve member and channel could be made from the same material or different materials. For instance, they may both be made from a semi-flexible plastic or the female element may be made from a rigid plastic and the male part made from a resiliently deformable material.

With certain products stored in containers over time there is a problem associated with gas building up inside the bottle over time. To release the build up of pressure, which can inevitably occur, a release valve is required. The air leak valve described above can be modified to additionally perform this function by providing one or more fine grooves in the side of the channel. These fine groove(s) will permit gas to slowly seep out of the container, by-passing the seal formed by the contact of the valve member with the sides of the channel, but prevent or minimise the volume of liquid that may seep out. Preferably, the groove or grooves formed in the side walls of the channel is/are formed on the external side of the point of contact between the valve member and the sides of the channel so that it/they are only exposed when the pressure inside the container increases and acts on the plunger to cause it to deform outwards (relative to the container). The plunger will return to its resiliently biased position in which the grooves are not exposed once any excess gas has been emitted. No liquid product should be lost during this process.

Alternatively, the gas pressure within the container could urge the valve member outwards so that it is displaced from the channel and defines an opening through which the gas could flow.

Seal

In preferred embodiments of the invention comprising at least two component parts, it is preferred that a seal is disposed at the join between the at least two interconnected parts to prevent any fluid leaking out of the dispenser nozzle. Any suitable seal would suffice. For instance, the two parts could be welded to one another or one part could be configured to snap fit into a sealing engagement with the other part or have possess a flange around its perimeter that fits tightly around the upper surface of the other part to form a seal therewith.

Preferably, the seal comprises a male protrusion formed on the abutment surface of one of the at least two parts that is received in a sealing engagement with a corresponding groove formed on the opposing abutment surface of the other part when the two parts are connected together.

The seal preferably extends around the entire chamber and the sides of the outlet passageway so that fluid leaking from any position within the chamber and or outlet passageway is prevented from seeping between the join between the two component parts.

In certain embodiments that comprise an outlet passageway the protrusion member may extend across the passageway and form the resiliently deformable valve member of the outlet valve. This portion of the protrusion will usually be thinner to provide the necessary resilience in the valve member to permit it to perform its function.

In certain embodiments of the invention, the male protrusion may be configured to snap fit into the groove or, alternatively, the male protrusion may be configured to resistively fit into the groove in a similar manner to the way in which a plug fits into the hole of a sink.

Dip Tube

In most cases, a dip tube may be integrally formed with the dispenser, or alternatively the body of the dispenser may comprise a recess into which a separate dip tube can be fitted. The dip tube enables fluid to be drawn from deep inside the container during use and thus, will be present in virtually all cases.

Alternatively, it may be desirable with some containers, particularly small volume containers, such as glues, perfume bottles and nasal sprays, to omit the dip tube, because the device itself could extend into the container to draw the product into the dispenser nozzle during use, or the container could be inverted to facilitate the priming of the dispenser with fluid. Alternatively, the device may further comprise a fluid compartment formed as an integral part of device from which fluid can be drawn directly into the inlet of the nozzle without the need for a dip tube.

Internal Chamber

The chamber of the nozzle device may be of any form and it shall of course be appreciated that the dimensions and shape of the dome will be selected to suit the particular device and application concerned. Similarly, all the fluid in the chamber may be expelled when the dome is compressed or, alternatively, only a proportion of the fluid present in the chamber may be dispensed, again depending on the application concerned.

In certain preferred embodiments of the invention, the chamber is defined by a generally dome-shaped resiliently deformable region of the body. Preferably, the dome-shaped region is formed on the upper surface of the body so that it is accessible for operation by a person using the nozzle. One problem with dome-shaped chambers can be that a certain amount of dead space exists within the chamber when it is compressed by an operator, and for some applications it will be preferable that the dead space is minimised or virtually negligible. To achieve this property, it has been found that flattened domes or other shaped chambers whereby the resiliently deformable wall of chamber can be depressed such that it contacts an opposing wall of the chamber and thereby expels all of the contents present therein are generally preferred. For this reason, a flattened dome is especially preferred because it reduces the extent with which the dome needs to be pressed inwards in order to compress the chamber and actuate the dispensing of fluid stored therein. It also reduces the number of presses required to prime the chamber ready for the first use.

In some cases, the resiliently deformable portion of the body may not be sufficiently resilient to retain its original resiliently biased configuration following deformation. This may be the case where the fluid has a high viscosity and hence tends to resist being drawn into the chamber through the inlet. In such cases, extra resilience can be provided by the positioning of one or more resiliently deformable posts within the chamber, which bend when the chamber is compressed and urge the deformed portion of the body back to its original resiliently biased configuration when the applied pressure is removed. Alternatively, one or more thickened ribs of plastic could extend from the edge of the resiliently deformable area towards the middle of this portion. These ribs will increase the resilience of the resiliently deformable area by effectively functioning as a leaf spring which compresses when a pressure is applied to the resiliently deformable portion of the body, and urges this portion back to its initial resiliently biased configuration when the applied pressure is removed.

Yet another alternative is that a spring or another form of resilient means is disposed in the chamber. As above, the spring will compress when the wall is deformed and, when the applied pressure is removed, will urge the deformed portion of the body to return to its original resiliently biased configuration and, in doing so, urges the compressed chamber back into its original "non-compressed configuration".

Integrally Formed with the Container

In most cases it is preferable that the nozzle device is adapted to be fitted to container by some suitable means, e.g. a snap fit or a screw thread connection. In certain cases, however, the nozzle device could be incorporated into a container as an integral part. For instance, the nozzle device could be integrally moulded with various forms of plastic container, such as rigid containers or bags. This is possible because the device is preferably moulded as a single material and, therefore, can be integrally moulded with containers made from the same or a similar compatible material.

According to a second aspect of the present invention, there is provided a container having a pump-action nozzle device as hereinbefore defined fitted to an opening thereof so as to enable the fluid stored in the container to be dispensed from the container through said nozzle device during use.

According to a third aspect of the present invention, there is provided a container having a pump-action nozzle device as hereinbefore defined integrally formed therewith so as to enable the fluid stored in the container to be dispensed from the container through said nozzle device during use.

According to a fourth aspect of the present invention, there is provided a pump-action nozzle device configured to enable fluid to be dispensed from a container, said nozzle having a body which defines an internal chamber having an inlet through which fluid may be drawn into said chamber and an outlet through which fluid present in the chamber may be expelled from the nozzle, said inlet comprising an inlet valve adapted to only permit fluid to flow into the chamber through the inlet when the pressure within the chamber falls below the pressure within the interior of the container to which the device is attached by at least a predetermined minimum threshold amount and said outlet comprising an outlet valve configured to only permit fluid to flow out of the chamber and be expelled from the nozzle when the pressure within the chamber exceeds the external pressure at the outlet by at least a predetermined threshold amount, wherein at least a portion of the body which defines said chamber is configured to:

(i) be displaceable from an initial resiliently biased position to a distended or deformed position in response to the application of a pressure, whereby the volume of said chamber defined by said portion of the body is reduced as said portion of the body is deformed from said initial position to said distended or deformed position, said reduction in volume causing the pressure within the chamber to increase and fluid to be ejected through the outlet; and (ii) subsequently return to its initial position when the applied pressure is removed, thereby causing the volume of the chamber to increase and the pressure therein to fall such that fluid is drawn into the chamber through the inlet valve;

characterised in that said nozzle device further comprises a trigger actuator, said trigger actuator comprising a trigger handle that can be pulled by an operator and an engagement portion configured to displace said portion of the body from its initial position when said trigger handle is pulled.

Preferably the nozzle device is as defined above.

In addition, it is also preferable, the part of the body that can be displaced inwards to reduce the volume of the chamber and thereby cause fluid present in said chamber to be ejected through the outlet is a piston mounted within a piston channel. The piston channel may form the entire chamber or, alternatively, just a portion thereof.

Preferably, the nozzle device comprises a means for displacing the piston inwards from its initial position and then subsequently returning it is initial position. This may be achieved by any suitable means, such as, for example, a trigger or over cap connected to the piston, which can be operated to displace the piston, when desired. Preferably, the trigger actuator is resiliently biased to retain said portion of the body in its initial position in the absence of any applied pressure.

Method of Manufacture

The nozzle devices of the present invention may be made by any suitable methodology know in the art.

As previously described, preferred embodiments of the invention comprise a body having two parts (a base and upper part) which fit together to define at least the chamber of the device and, more preferably, the chamber and at least a portion of the outlet. In addition, the device further comprises a trigger actuator.

According to a further aspect of the present invention, there is provided a method of manufacturing a nozzle device as hereinbefore defined, said nozzle device having a body composed of at least two interconnected parts and comprises a trigger actuator, said method comprising the steps of:

(i) moulding said parts of the body and said trigger actuator;

(ii) connecting said parts of the body together to form the body of the nozzle device; and (iii) fitting the trigger actuator to the body of the nozzle device.

Each part of the body and the trigger actuator may be a separate component part, in which case the component parts are initially formed and then assembled together to form the nozzle device. Each component part may be made from the same or a different material.

Alternatively, and more preferably, the two parts of the body or one of the parts of the body and the trigger actuator may be integrally formed with one another and connected by a bendable/foldable connection element. In such cases, the connected parts are formed in a single moulding step and then assembled together with the remaining part to form the nozzle device. For instance, the base and upper part of the preferred embodiments of the device may be integrally formed and connected to one another by a foldable/bendable connection element. Once formed, the upper part can be folded over and connected to the base to form the assembled nozzle device. The trigger actuator may then be fitted to the body of the nozzle device as a separate component.

In especially preferred embodiments of the invention, the device is formed from a single component part, which comprises the two parts of the body and the trigger actuator, all integrally formed with one another and connected to one another by foldable/bendable connection elements. Thus, the entire device is formed in a single moulding step from a single material. Once formed, the two parts forming the chamber of the device can be connected together and the trigger actuator can then be connected into a position whereby it extends across the resiliently deformable portion of the body.

It shall be appreciated that integrally formed component parts are preferably formed from the same material in single moulding step.

As an alternative, the nozzle device may be formed by a bi-injection moulding process whereby a first component part of the body is formed and a second part is then moulded onto the first part. Each part may be moulded from the same or a different material. As before, the trigger actuator may be a separate component part that is then fitted to the body of the nozzle device, or it may be integrally formed with one of the parts of the body.

Once the two parts of the body are connected to one another to form the assembled body of the device, the two parts may be over moulded with another plastic to hold the two parts together According to a further aspect of the present invention, there is provided a method of manufacturing a nozzle device as hereinbefore defined, said nozzle device having a body composed of at least two interconnected parts and further comprising a trigger actuator, said method comprising the steps of:

(i) moulding a first of said parts of the body in a first processing step;

(ii) over-moulding the second of said parts onto the first of said parts in a second processing step to form the body of the nozzle device; and (iii) connecting the trigger actuator to the body of the nozzle device.

The at least two parts are preferably moulded within the same moulding tool in a bi-injection moulding process. Usually the first part will be the base part of the nozzle device and the second part will be the upper part.

According to a further aspect of the present invention, there is provided a method of manufacturing a nozzle device as hereinbefore defined, said nozzle device having a body composed of at least two interconnected parts and further comprising a trigger actuator, said method comprising the steps of:

(i) moulding a first of said parts of the body in a first processing step together with a framework or base for a second of said parts; and (ii) over-moulding onto the framework or base to form the second of said parts of the assembled nozzle device; and (iii) connecting the trigger actuator to the body of the nozzle device.

The framework for the second part may be fitted to the base prior to the over-moulding step.

Alternatively, the over-moulding may take place before the framework for the second part is fitted to the first part.

The over-moulding may be the same material to that of the first part and the framework of the second part or it may be a different material.

It is especially preferred that the base is moulded first from a rigid plastic material together with the framework support for the upper part. The framework for the upper part is preferably connected to the base by a hinged or foldable connection member, which enables the framework to be folded over and fitted to the base during the assembly of the final product. The framework is over moulded with a compatible flexible, resiliently deformable plastic material which forms the resiliently deformable portion of the body that defines the chamber. The resiliently deformable plastic material may also form resiliently deformable valve members for the outlet valve and the inlet valve. It may also extend over other parts of the nozzle surface to provide a soft-touch feel to the device when an operator grips it. The rigid framework of the upper part may form an outer edge of the upper part, which forms the point of connection with the base and, in embodiments where a spray nozzle passageway is present, the framework may also form an upper abutment surface which contacts a lower abutment surface formed the base to define the spray passageway and outlet orifice.

According to a further aspect of the present invention, there is provided a method of manufacturing a nozzle device as hereinbefore defined, said nozzle device having a body composed of at least two interconnected parts and further comprising a trigger actuator, said method comprising the steps of:

(i) moulding a first of said parts of the body in a first processing step together with a framework or base for a second of said parts; and (ii) positioning an insert portion of the body such that said insert is retained within the framework of the second part of the body when said framework is connected to the first parts of the body, said framework and insert forming the second part of the body; and (iii) connecting the trigger actuator to the body of the nozzle device.

According to a further aspect of the present invention, there is provided a method of manufacturing a nozzle device as hereinbefore defined, said nozzle device having a body composed of at least two interconnected parts and a trigger actuator, wherein said parts and said trigger actuator are connected to one another by a connection element such that said parts are moveable relative to one another, said method comprising the steps of:

(i) moulding the parts of the body and the trigger actuator together with said connection elements in a single moulding step;

(ii) moving said parts of the body into engagement with one another to form the body of the nozzle device; and (iii) moving the trigger actuator into engagement with the body to form the nozzle device.

Blowing Agent

Preferably, a blowing agent is incorporated into the mould together with the plastic material. The blowing agent produces bubbles of gas within the moulded plastic that prevent the occurrence of a phenomenon known as sinkage from occurring. The problem of sinkage and the use of blowing agents in the manufacture of blowing agents to address this problem is described further in the applicant's co-pending International Patent Publication No. WO03/049916, the entire contents of which are incorporated herein by reference.

How the invention may be put into practice will now be described by way of example only, in reference to the accompanying drawings, in which:

FIG. 3 is a perspective view of the upper part 102 shown in FIG. 1;

Figure 9A:
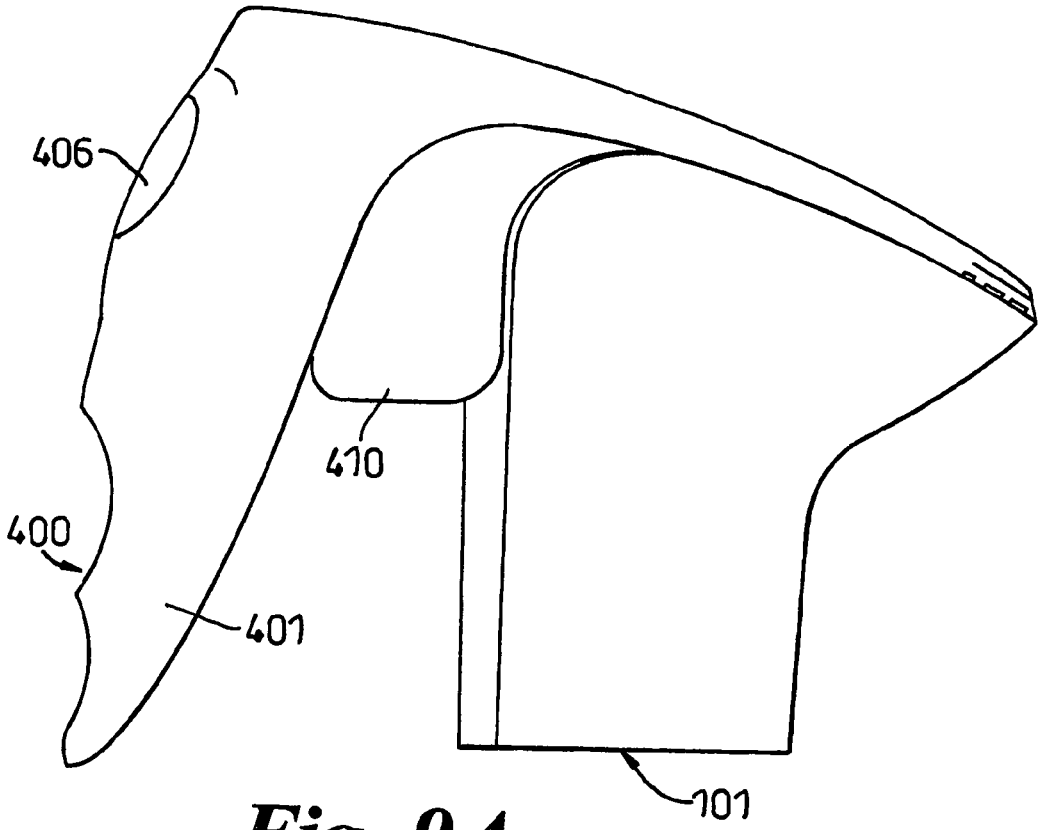
FIGS. 9A and 9B show perspective views of an alternative nozzle device according to the invention.
Figure 9B:
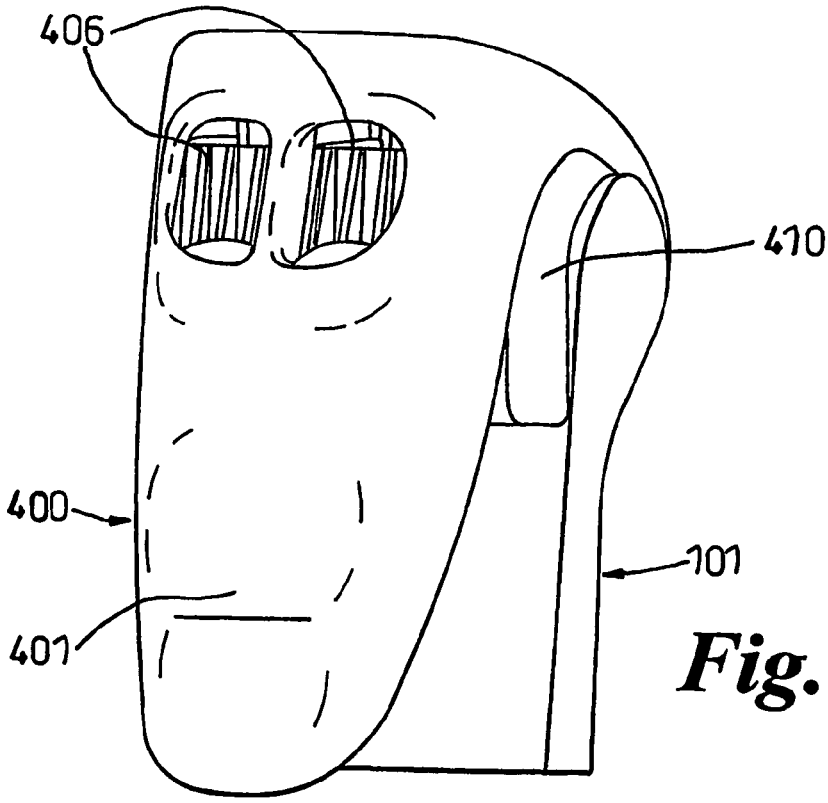
Figure 9C:
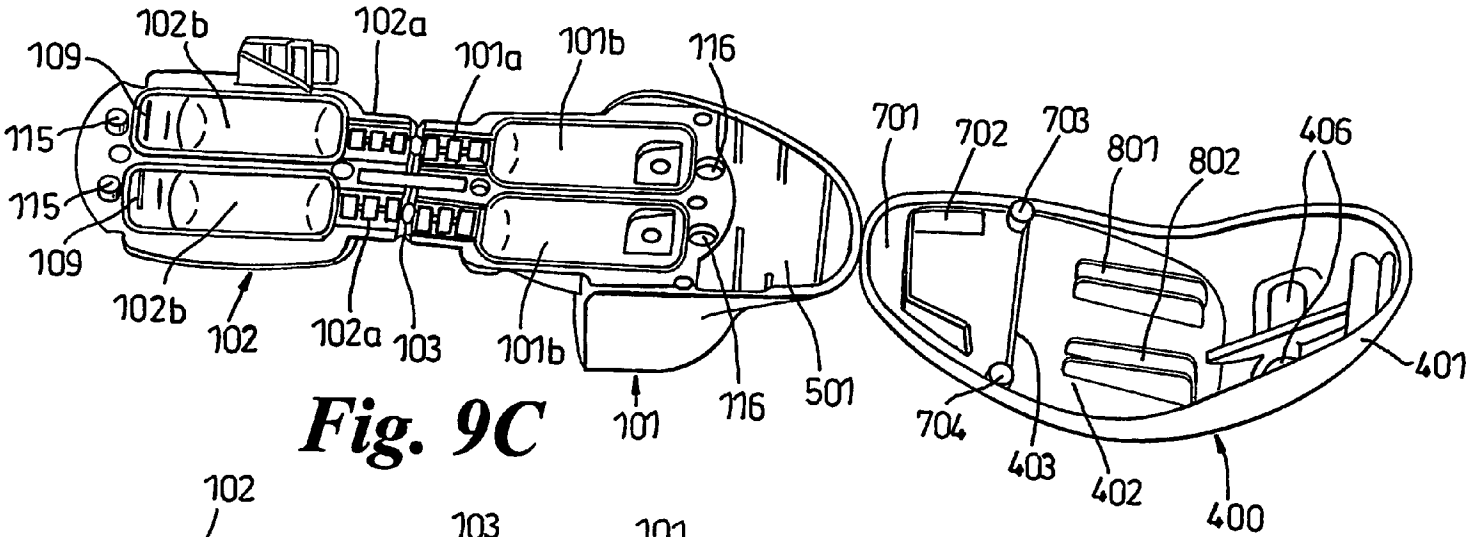
Figure 9D:
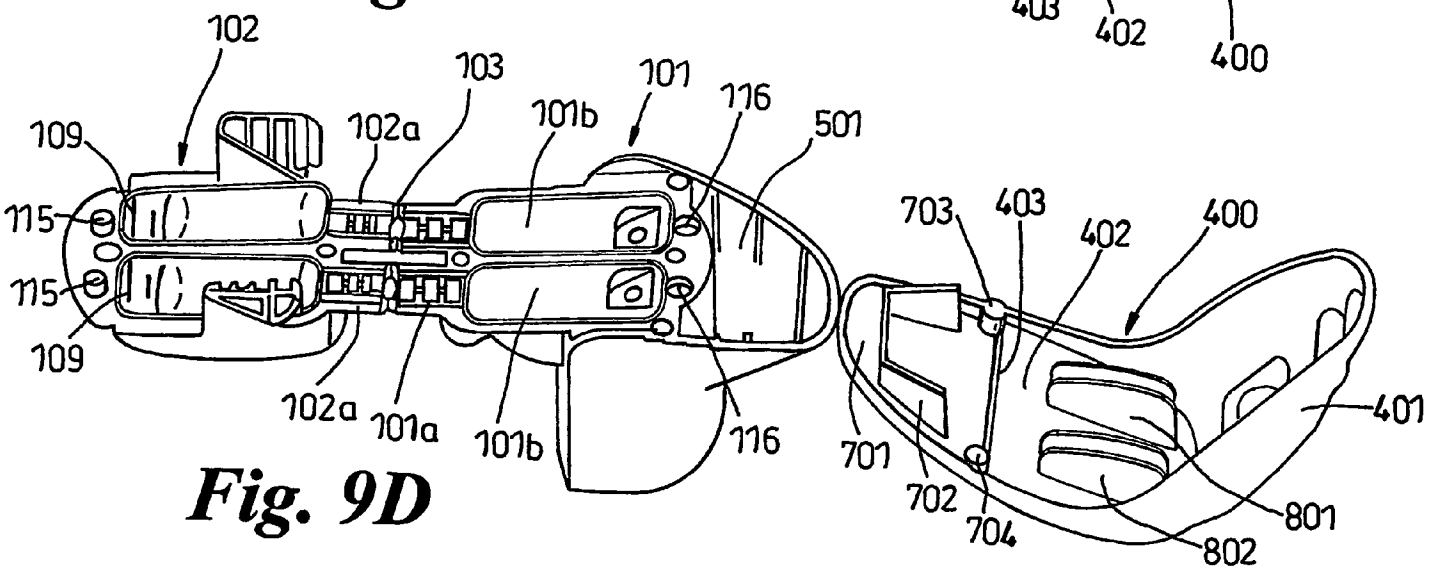
Figure 9E:
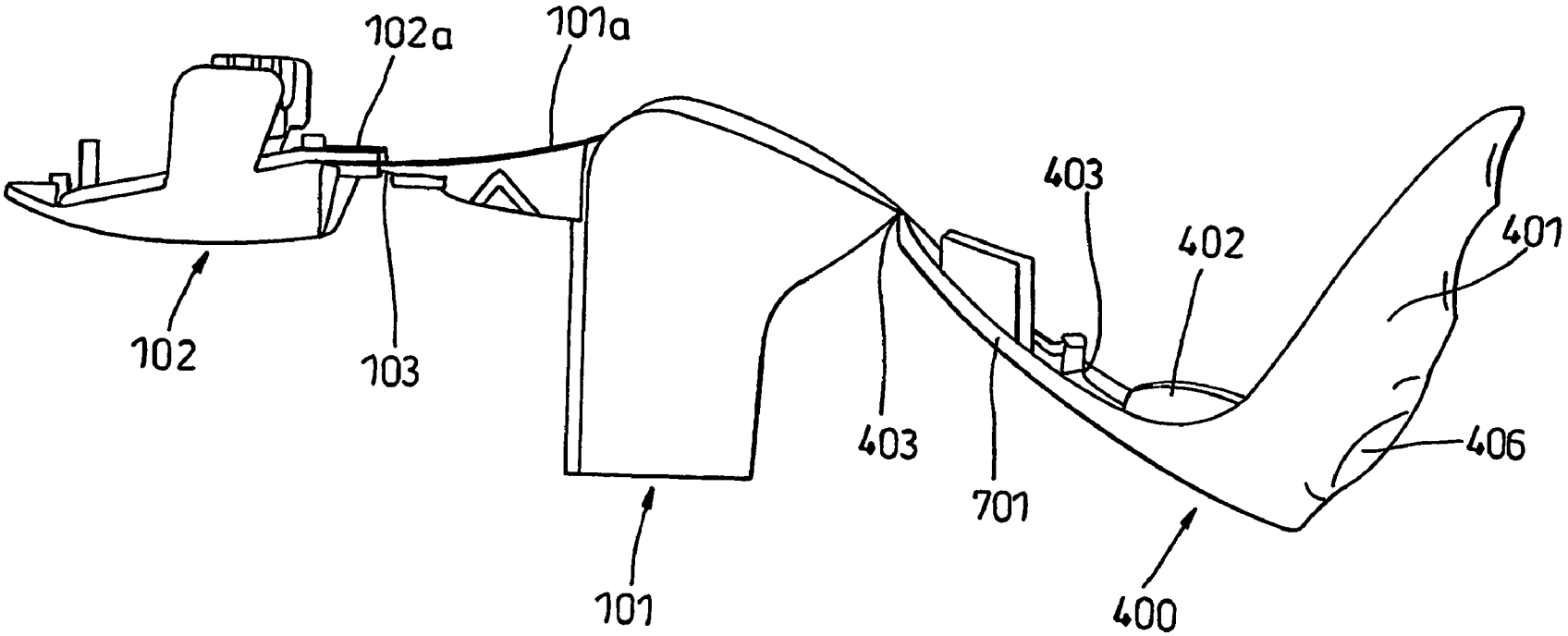
Figure 9F:
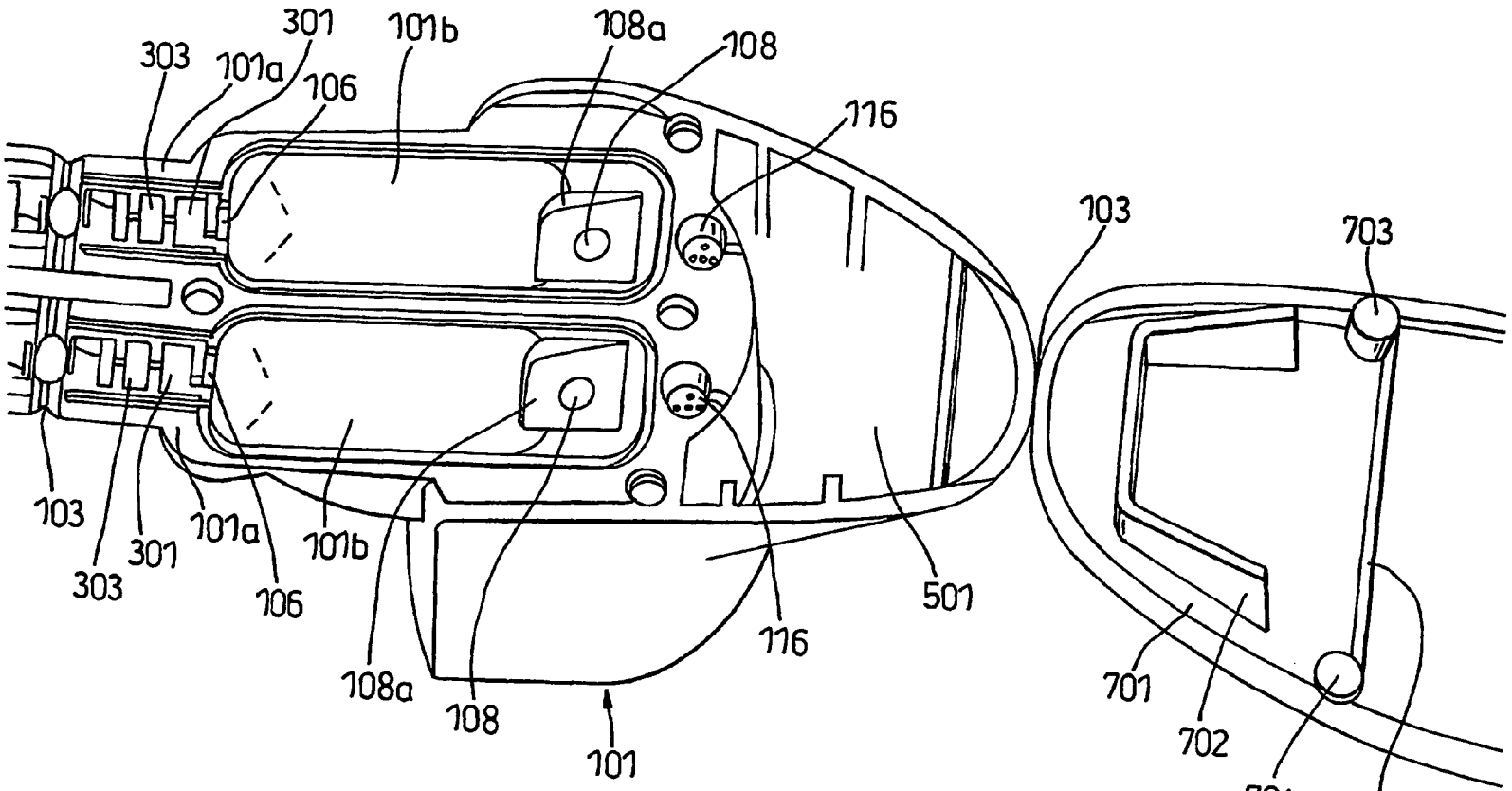
Figure 9G:
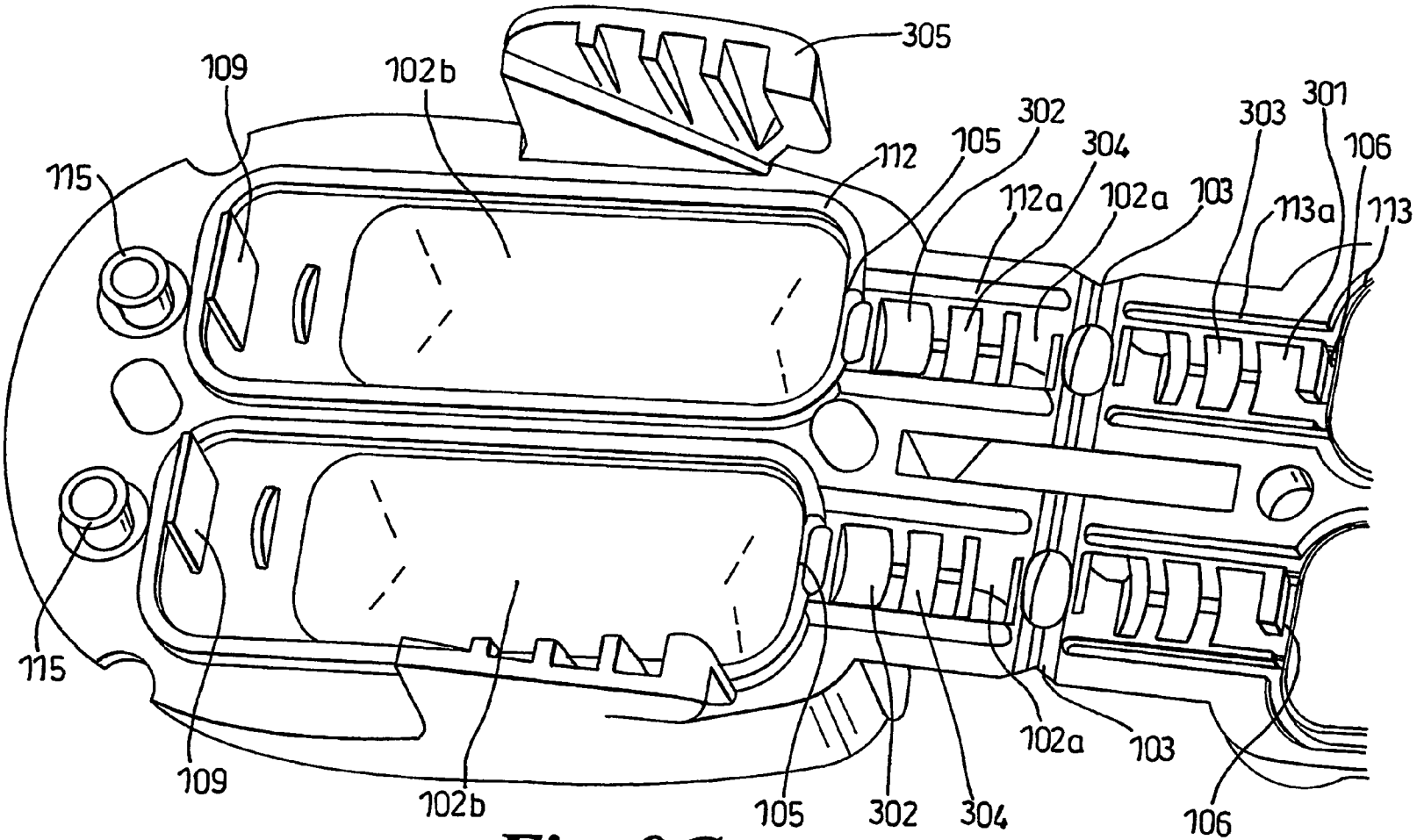
Figure 10:
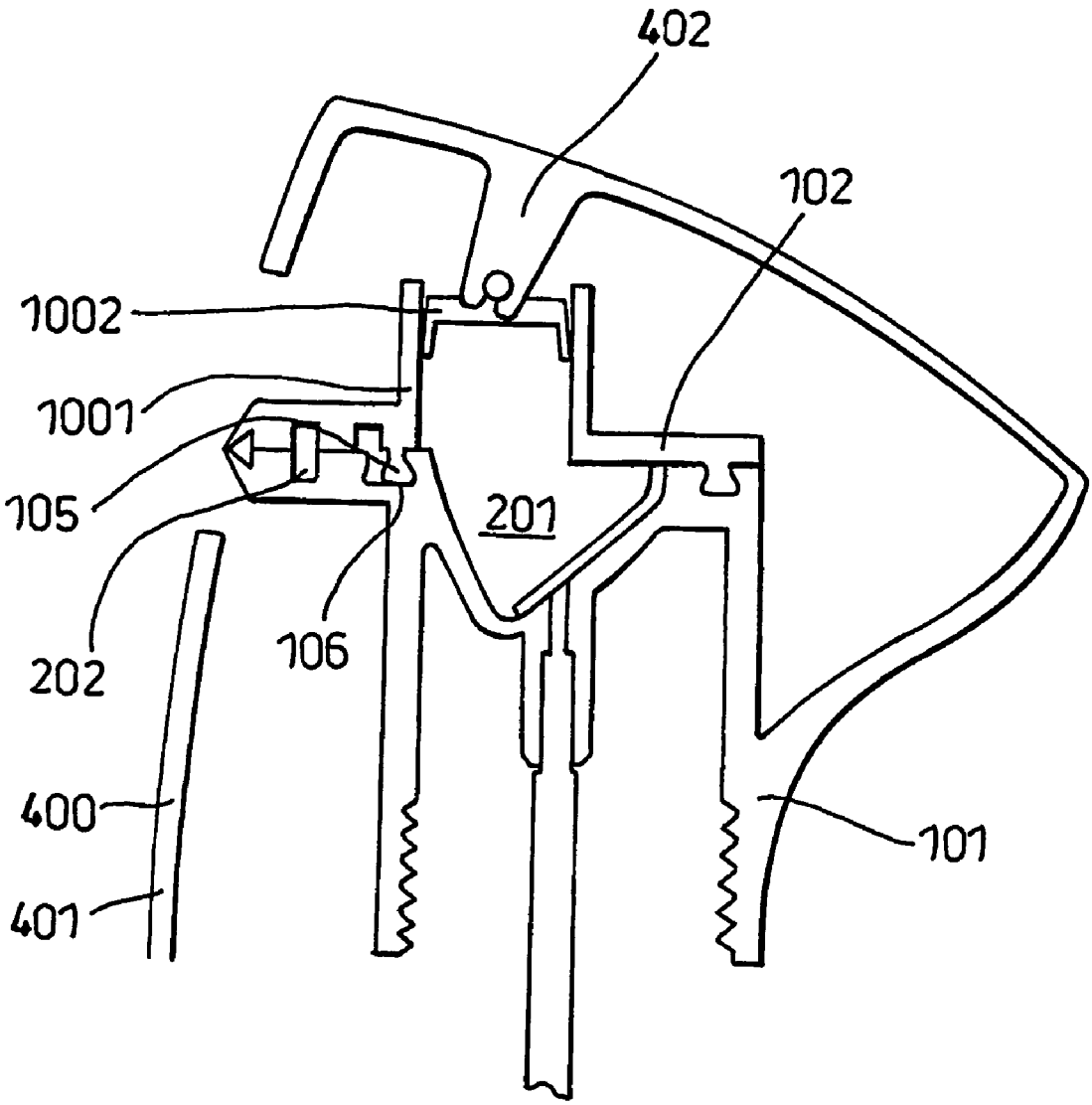

FIGS. 9C, 9D and 9E all show perspective views of the embodiment shown in FIGS. 9A and 9B with the constituent parts separated to show the internal features;

FIGS. 9F and 9G show magnified views of portions of the nozzle arrangement shown in FIG. 9C; and FIG. 10 is a cross-sectional view taken through an alternative embodiment of the invention.

In the following description of the figures, like reference numerals are used to denote like or corresponding parts in different figures, where appropriate.

Figure 1A:
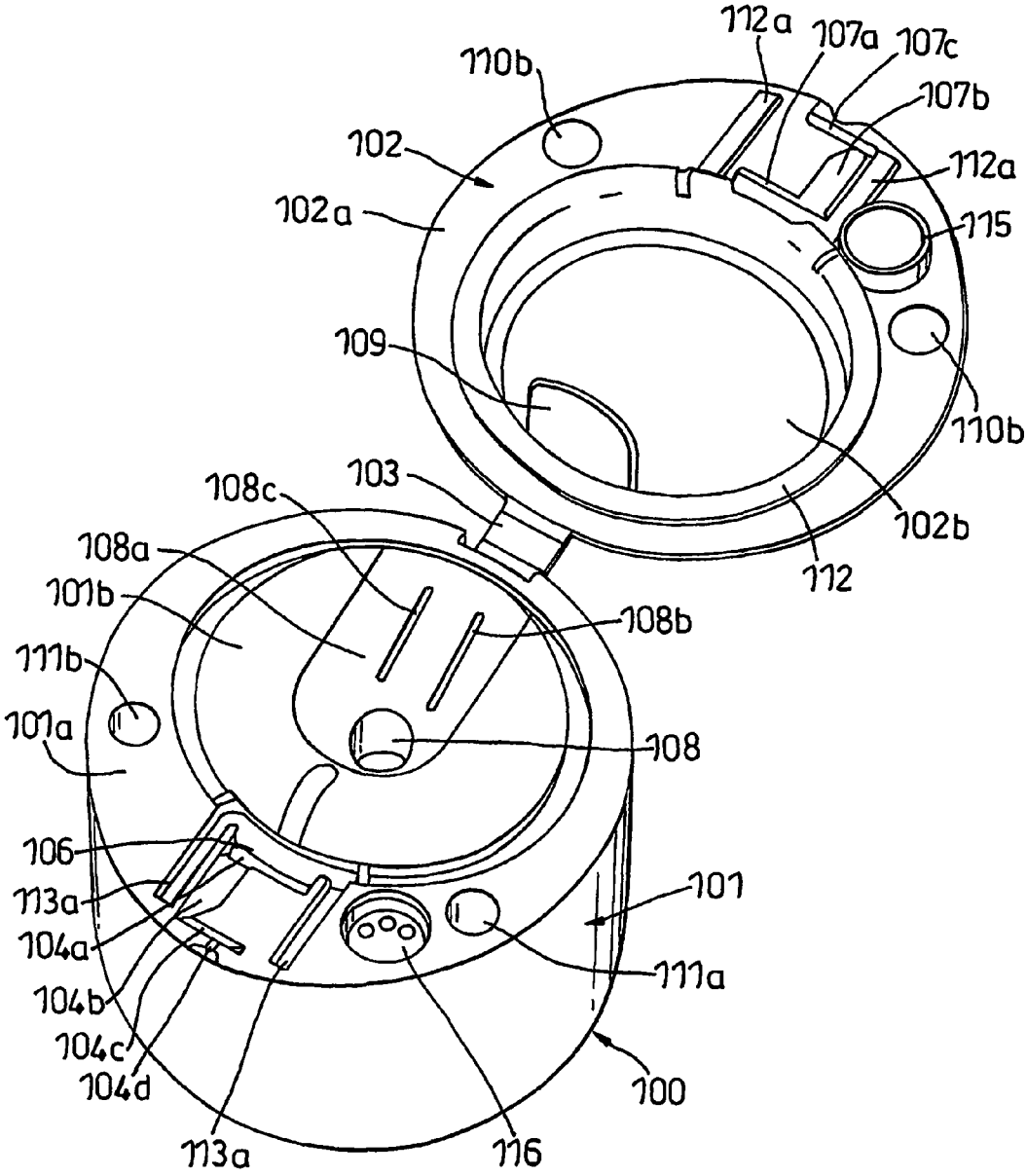
FIG. 1A is a perspective view of an example of a nozzle device adapted to dispense fluid in the form of a spray and which comprises a body formed of two component parts.
Figure 1B:
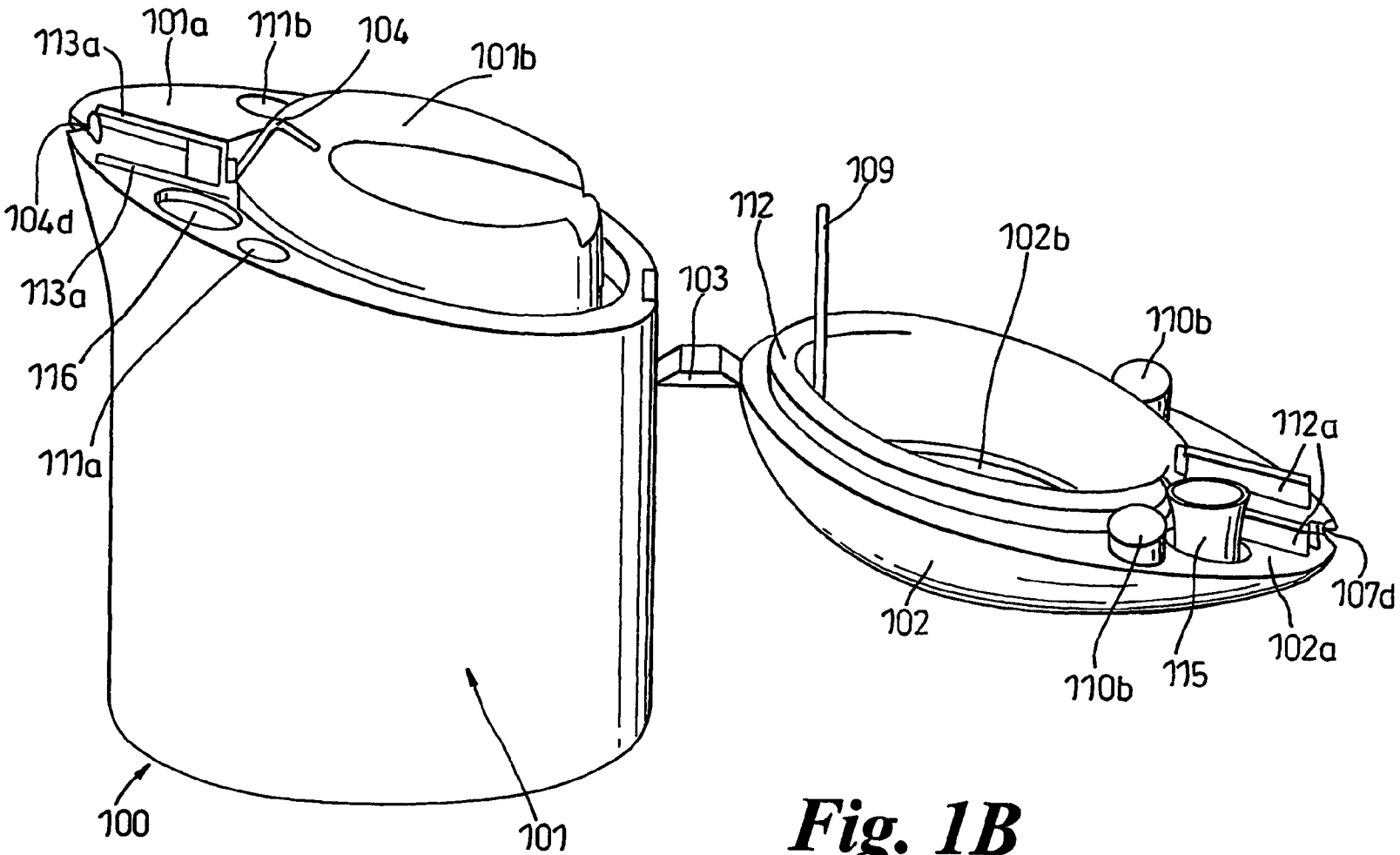
FIG. 1B is a further perspective of the device shown in FIG. 1A.

The nozzle device shown in FIGS. 1A and 1B comprises a body 100 formed of two parts, namely a base part 101 and an upper part 102, which are connected to one another by a foldable connection element 103.

The body 100 is formed from a single rigid plastic material in a single moulding operation. The device will be moulded in the configuration shown in FIGS. 1A and 1B and then the upper part 102 will be folded over about the connection element 103 and fitted to the upper surface of the base 101 to form the assembled nozzle arrangement. Once the base 101 and the upper part 102 are fitted together, the portion 102*a* of the under surface of the upper part 102 abuts the abutment portion/surface 101*a* of the upper surface of the base 101. The elevated portion 101*b* of the upper surface of the base 101 is received within recess 102*b* formed in the under surface of the upper part 102 to define an internal chamber.

A groove 104 formed in the elevated portion of the base 101*b* forms an initial portion of an outlet passageway in the assembled nozzle arrangement that leads from the internal chamber to an outlet valve. The outlet valve is formed by a resiliently deformable flap 105 formed on the under surface of the upper part 102 which is received within a recess 106 formed in the opposing abutment surface 101*a* of the base. The flap 105 extends over the end of the groove 104 when the base and upper parts are connected together to close the outlet passageway. The flap 105 is configured to resiliently deform away from the end of the groove 104 when the pressure within the internal chamber exceeds a predetermined minimum threshold to define an open passageway, as described further below. The flap 105 is also formed as a continuation of the ridge protrusion 112 discussed further below.

The remainder of the fluid flow passageway is defined by the alignment of grooves and or recesses 104*a*, 104*b* and 104*c* formed in the abutment surface 101*a* of the base 101 with corresponding grooves and/or recesses 107*a*, 107*b* and 107*c*, respectively. The portions 104*c* and 107*c* are semicircular recesses which align to form a circular swirl chamber which induces rotational flow into liquid passing through the outlet passageway during use. Liquid is ejected from this chamber during use through an outlet formed by the alignment of grooves 104*d* and 107*d* respectively.

The base 101 also defines an inlet orifice 108, which is positioned within a recess 108*a* formed in the elevated portion 101*b*. A resiliently deformable flap 109 formed on the under surface of the upper part 102 is received within the recess 108*a* in the assembled nozzle arrangement and is resiliently biased against the inlet opening to close off the inlet. The flap 109 is configured to resiliently deform away from the inlet opening to permit fluid to be drawn into the chamber when the pressure therein falls below the pressure in the attached container by at least a predetermined minimum threshold amount. The opening of the inlet 108 is provided with a lip against which the flap 109 abuts to form a seal. Supporting ribs 108*b* and 108*c* prevent the flap 109 exerting too much force on the lip.

Locating posts 110*a* and 110*b* formed on the under surface of the upper part 102 are received within holes 111*a* and 111*b* formed in the base and assist in holding the base and the upper part in tight abutment with one another. In addition, a ridge protrusion 112, which extends around the recess 102*b* is received within, and forms a sealing engagement with, a correspondingly shaped groove 113, which is formed in the upper surface of the base 101 and extends around the elevated portion 101*b*. The ridge 112 and groove fit tightly together to assist in holding the base 101 and the upper part 102 in tight abutment with one another. The ridge and groove also form a seal that prevents any fluid leaking out of the chamber and seeping between the upper part and the base. This seal also extends to encompass the outlet passageway and the outlet orifice by virtue of portions 112*a* and 113*a*.

The body also comprises an air leak valve which consists of a resiliently deformable member 115 formed on the under surface of the upper part 102, which is received within an opening 116 formed on the abutment surface 101*a* of the base when the nozzle arrangement is assembled. The opening 116, together with the groove 115 defines a passageway through which air may flow into the container from the outside in the assembled nozzle arrangement. The tip of the resiliently deformable member 115 is provided with a flared rim, the edges of which abut the internal walls of the opening 116 to form an airtight seal. If a reduced pressure exists in the container as a consequence of expelling fluid through the nozzle arrangement, the pressure differential between the interior of the container and the external environment causes the flared rim of the member 115 to deform inwards, thereby permitting air to flow into the container from the external environment. Once the pressure differential has been equalised, the flared rim returns to its original configuration resiliently biased configuration to prevent any further flow through the opening 116. It shall also be appreciated that if the container is inverted, the product cannot leak past the rim of the resiliently deformable member 115 and any pressure that is applied, by squeezing the container for example, simply pushes the flared rim into tighter abutment with the walls of the opening 116.

In an alternative embodiment, the air leak valve may be a post or flap positioned within a hole which can resiliently deform to open the passageway when a pressure differential exists, thereby allowing air to flow into the container from the external environment.

As a further alternative, the resiliently deformable upper part 102 could comprise a fine slit above an opening similar to opening 116. This slit could be configured to open when a pressure differential exists.

As yet another alternative, the air release may be positioned closer to the resiliently deformable upper part 102 and configured such that, when the upper part is pressed downwards to expel the contents present in the chamber, the resiliently deformable member deforms in such a way that the air valve is opened, and air may flow into or out of the chamber to equalise any pressure differential that may exist.

Referring to FIGS. 1B, 3, 4A and 4B, during use, an operator will press the non-planar outer surface of the generally dome-shaped portion 102*b* of the upper part 102 inwards, which is the resiliently deformable portion of the body 100 and together with the non-planar portion 101*b* of the base 101 defining defines the chamber. This generally dome-shaped portion 102*b* of the upper part 102 can be easily pressed into abutment with the upper surface of the second portion 101*b* of the base 101 and thereby compresses the internal chamber defined there between and causes the pressure therein to increase. When the pressure exceeds a predetermined minimum threshold value, the flap 105 will be displaced from its resiliently biased position to define an opening through which liquid can flow through the remainder of the outlet passageway to the outlet orifice where it is ejected in the form of a spray. As soon as the pressure within the chamber falls back below the predetermined minimum threshold value, the flap 105 will return to its resiliently biased configuration to close of the outlet passageway. When the applied pressure is removed from portion 102*b* of the upper part 102 it will return to its resiliently biased position and the volume of the chamber will increase. This causes the pressure within the chamber to decrease and the flap 109 of the inlet valve to be displaced to permit more liquid to be drawn into the chamber through the inlet valve.

Figure 2:
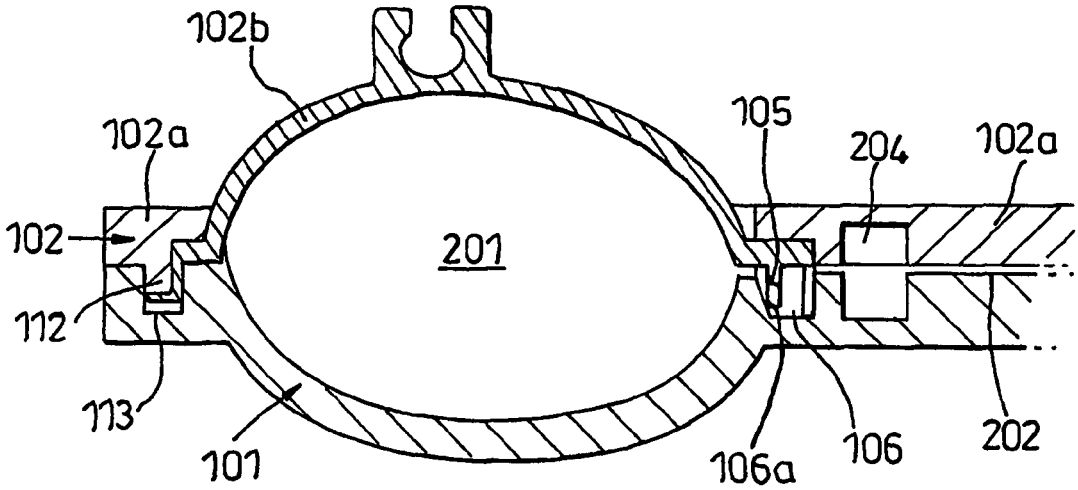
FIG. 2 is a cross-sectional diagrammatic view of an example of a further nozzle device adapted to dispense fluid in the of a spray and which comprises a body formed of two component parts.

A further example of a nozzle device adapted to dispense fluid in the form of a spray is shown in FIG. 2. In this example, only the internal chamber 201 and outlet passageway 202 are shown for the purpose of illustration. An inlet, although not shown, would usually be present in practice.

The example shown in FIG. 2 comprises a base made from a rigid plastic and an upper part 102 which comprises an abutment surface portion 102*a* formed from a rigid plastic, and a resiliently deformable portion 102*b*, which defines the chamber 201 together with portion 101*b* of the base 101 is made from a resiliently deformable material. This embodiment of the nozzle device may be formed by a bi-injection moulding process whereby the base and the portion 102*a* of the upper part 102 are moulded from a rigid plastic and the portion 102*b*, which is formed from a resiliently deformable plastic is then moulded onto the portion 102*a*. The base 101 and upper part 102 are then fitted together to form the assembled nozzle device. Optionally, the portion 102*a* and the base may be moulded from the same material and connected to one another by a foldable connection element.

In the embodiment shown in FIG. 2, the outlet valve again comprises flap 105 received within a recess 106 formed on the opposing abutment surface of the upper part. The side 106*a* of the recess is angled so that the flap 105 is resiliently biased to abut the edge to form a tight seal at its lower end.

The flap is deflected from the side 106*a* to define an opening through which fluid can flow when the required pressure is achieved in the chamber 201. Fluid then flows along the outlet passageway to the outlet orifice (not shown) and on its way it passes through an expansion chamber 204 formed by aligned recesses formed on the opposing abutment surfaces 102*a* and 101*a*.

FIG. 3 shows the upper part 102 and base 101 of the embodiment shown in FIG. 2. Again, although not shown, the upper part also comprises a flap projection 109 which covers an inlet 108 formed in the base 101 to form the inlet valve, as discussed above. In this embodiment, the upper part 102 comprises a frame of rigid plastic material, which forms portion 102*a* of the upper part and which surrounds a region of resiliently deformable material, which forms portion 102*b* of the upper part 102, as previously described. The rigid plastic portion 102*a* abuts the portion 101*a* of the base (as shown in FIG. 2) to define the outlet passageway. As can bee seen from FIG. 3, outlet passageway 202 comprises a first expansion chamber 204 formed by the alignment of recesses 301 and 302, and a second outlet chamber formed by the alignment of recesses 303 and 304.

To ensure a tight abutment between the upper part 102 and the base 101, the clip 305 formed on the abutment surface of the upper part 102 engages with recesses/cavities formed in the abutment surface 101*a* of the base to locate and secure the upper part and the base together.

The nozzle devices shown in FIGS. 1 to 3 comprise a generally dome-shaped protrusion on the upper surface, which must be deformed inwards by an operator in order to facilitate the compression of the chamber and cause the contents stored therein to be expelled through the outlet. One potential problem with such designs is that the operator needs to press the dome using their finger, which requires the operator to position their finger in the correct location to ensure that the chamber is compressed and fluid is ejected through the outlet. It has also been found that a relatively high pressure is required to press the dome to a sufficient extent, which can be a further disadvantage, especially as it is commonplace for people to actuate conventional pump dispensers by applying pressure with a different portion of the their hand, such as using their palm, or even using their elbow or forearm. In these instances, it would be much more problematical to adequately compress the dome using, for example, the palm of the hand in order actuate the ejection of fluid from the device.

Figure 4A:
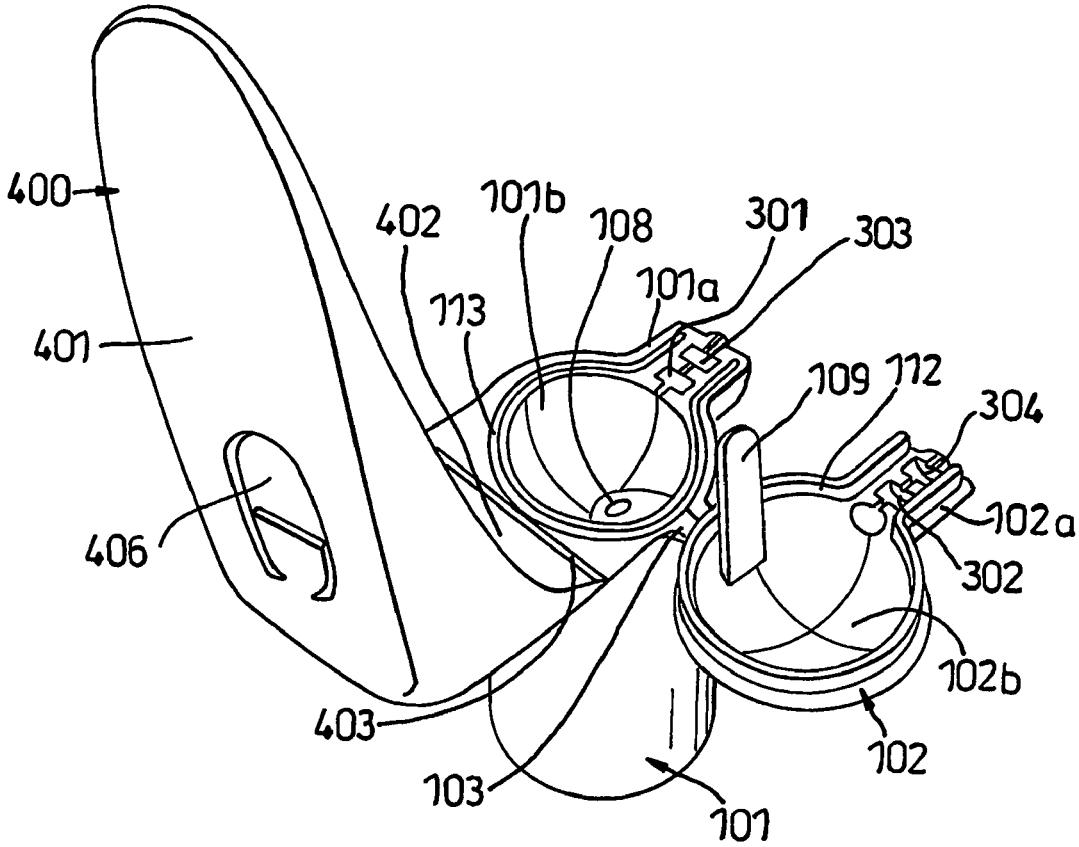
FIG. 4A is a perspective view of an embodiment of a nozzle device according to the invention in a dissembled configuration.
Figure 4B:
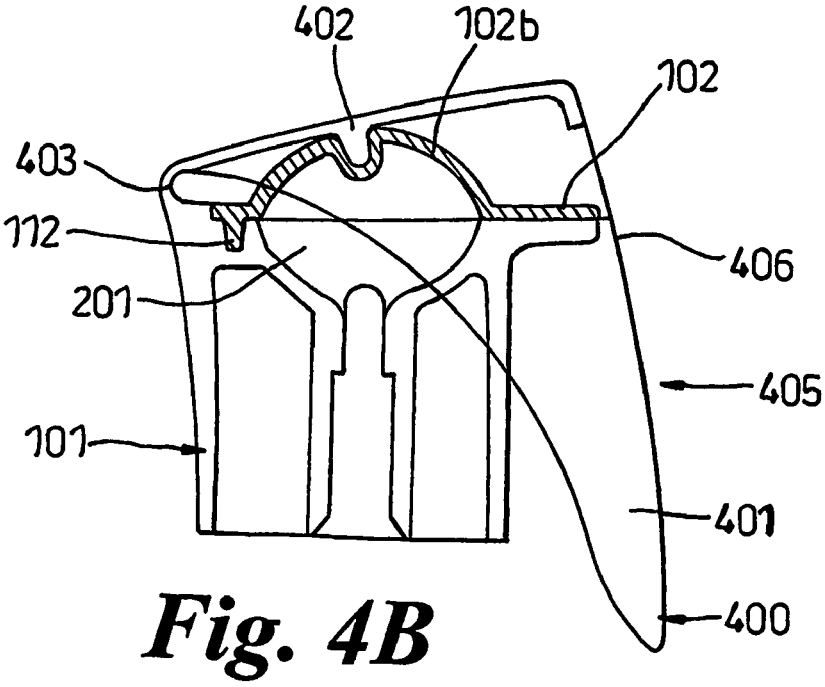
FIG. 4B is a cross-sectional view taken through the embodiment shown in FIG. 4A in an assembled configuration.

An embodiment of the invention is shown in FIGS. 4A and 4B. Referring to FIG. 4A, the device comprises a second part or base 101 having an abutment portion 101*a* and a non-planar, concave chamber defining portion 101*b*. Connected to the base 101 by a foldable/bendable connection element 103 is an upper first part 102 comprising an abutment portion 102*a* and a nonplanar, generally dome-shaped deformable chamber defining portion 102*b* which when depressed is deformed into the concave portion 101*b* of the second part or base 101 thereby reducing dead space within the chamber during activation.

The upper part 102 can be folded over about the connection element 103 so that the abutment portions 102*a* of the upper part and 101*a* of the base contact one another. As previously described, the grooves 104 and 107 align to define an outlet passageway with two expansion chamber formed along it length by the alignment of recesses 301 and 302, and 303 and 304, respectively. This produces a spray of the fluid ejected and, in this case, the minimum threshold pressure required to open the outlet valve and eject fluid will be sufficient to ensure that the fluid is forced through the outlet passage and expansion chambers with adequate force to generate a spray having the desired characteristics (i.e. droplet size, dispersion etc.). A seal is formed by the engagement of the protrusion 112 within the corresponding groove 113 and the flap 109 forms a resiliently deformable valve member that sits over the inlet 108. The device also comprises an outlet valve although this is not shown in FIG. 4A. Although not shown, the device also preferably comprises an air leak valve (such as that shown in FIGS. 1A and 1B).

Integrally formed with the base 101 is a trigger actuator 400 comprising a trigger handle 401 and an engagement portion 402, which is substantially perpendicular to the plane of the handle 401. The trigger 400 is connected to the base by a bendable/foldable connection 403, which enables the handle to folded over such that the engagement portion extends across the resiliently deformable surface 102*b* of the upper part 102 and the handle extends downwards at the front of the device, as shown in FIG. 4B. The trigger is configured to pivot about the connection 403 when the trigger is pulled in the direction of arrow 405 in the conventional manner. This pivoting action causes the surface 102*b* to be deformed towards the opposing surface 101*a* of the base, thereby compressing the chamber and causing fluid to be dispensed through the outlet of the device in the form of a spray. Fluid ejected from the outlet orifice passes through the hole 406 formed in the handle 401. When the trigger is released, the resiliently deformed portion 102*b* of the upper part will return to its initial resiliently biased configuration and urge the trigger back to its initial "non-actuated" position.

Referring to FIGS. 4A and 4B, it shall be appreciated that the device could be moulded as a single component in the configuration shown in FIG. 4A and then assembled by flipping the upper part over and fitting it to the base to from the body of the nozzle device and then folding over the trigger actuator. This construction is generally preferred because of the ease with which the device can be manufactured, i.e. using a single plastic material and a single moulding step.

As an alternative, however, the trigger 400, base 101 and the abutment portion 102*a* of the upper part could all be moulded from a single material (typically a rigid plastic material) in a single moulding step, but the resiliently deformable, chamber-defining portion 102*b* of the upper part 102 could instead be an insert made from a resiliently deformable material that is fitted into the upper part of the device or, more preferably, it may be formed from a second resiliently deformable material which is moulded onto the portion 102*a* of the upper part in a bi-injection moulding process (i.e. a second subsequent moulding step).

Figure 5A:
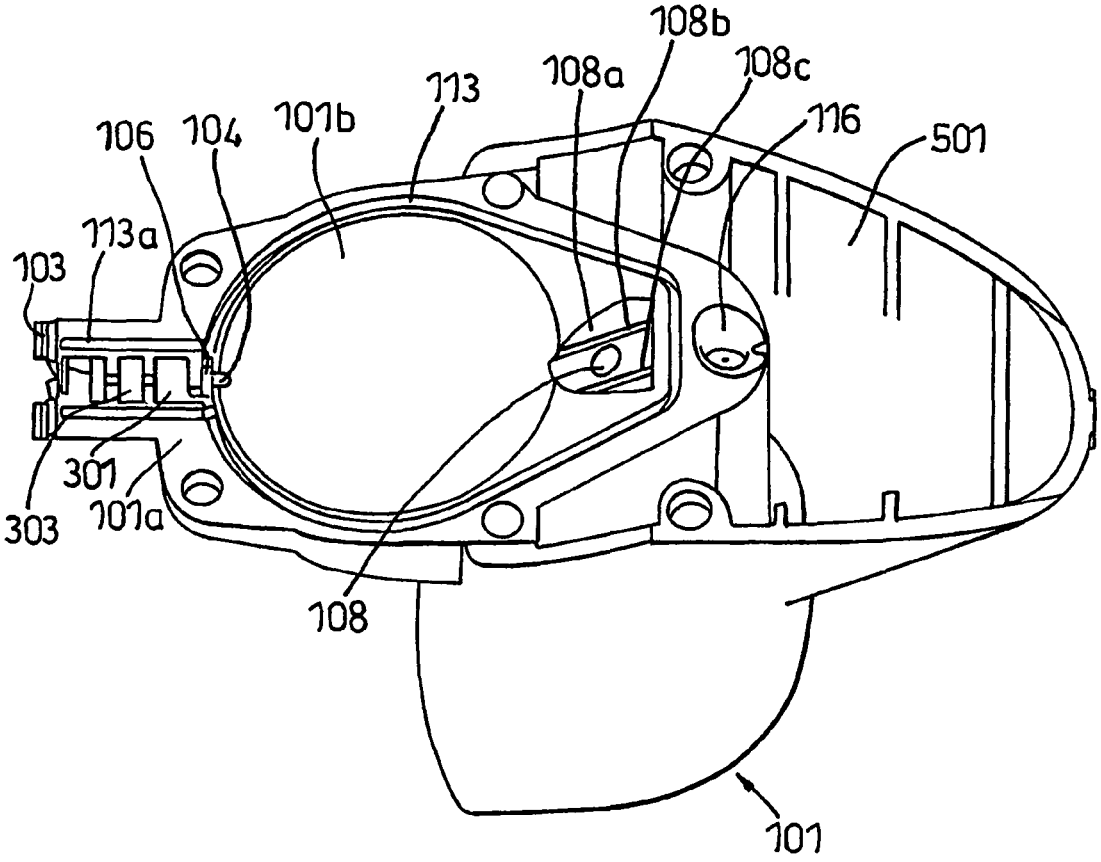
FIGS. 5A and 5B show perspective views of the base portion 101 of an alternative embodiment of the present invention.
Figure 5B:
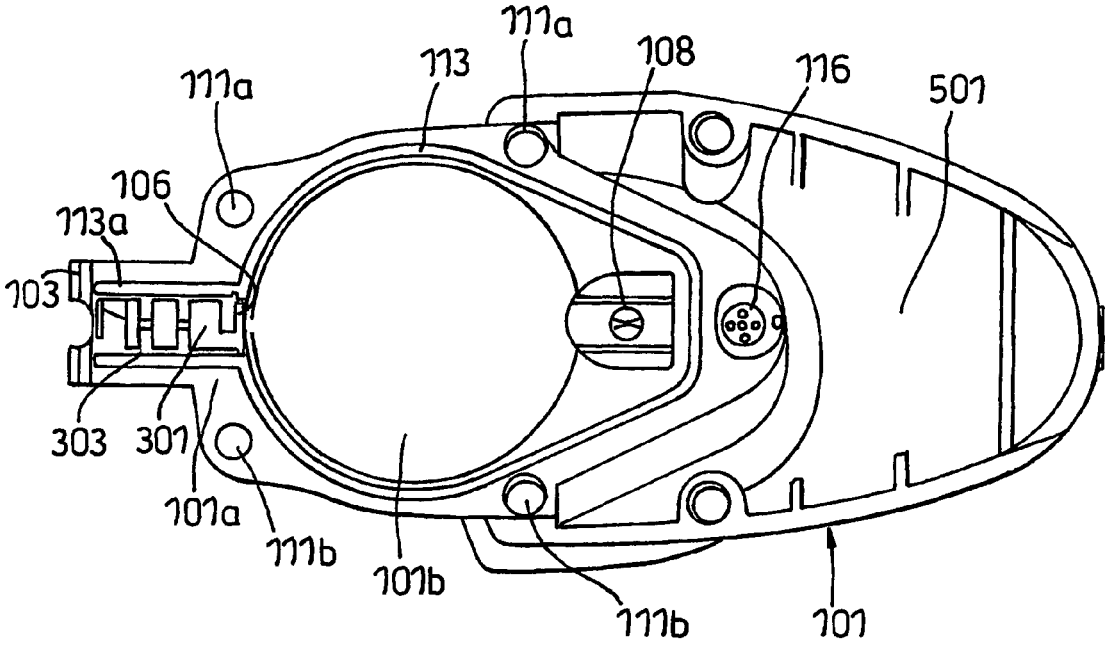
Figure 6A:
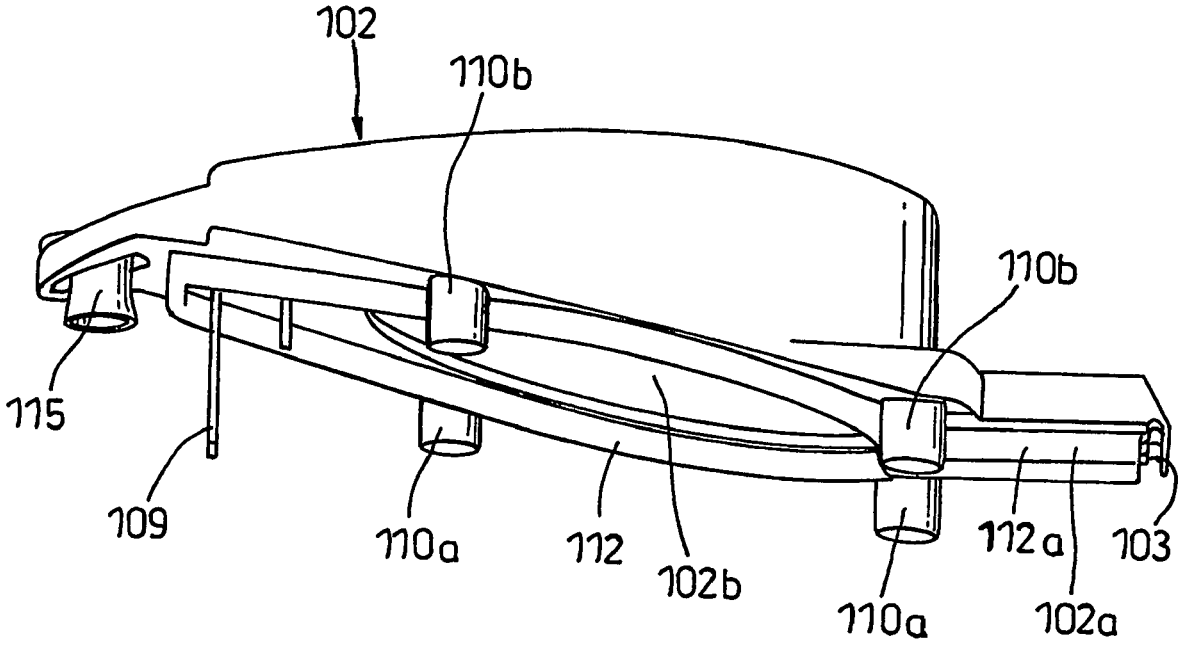
FIGS. 6A and 6B show perspective views of the upper part 102 adapted to be fitted to the base 101 shown in FIGS. 5A and 5B.
Figure 6B:
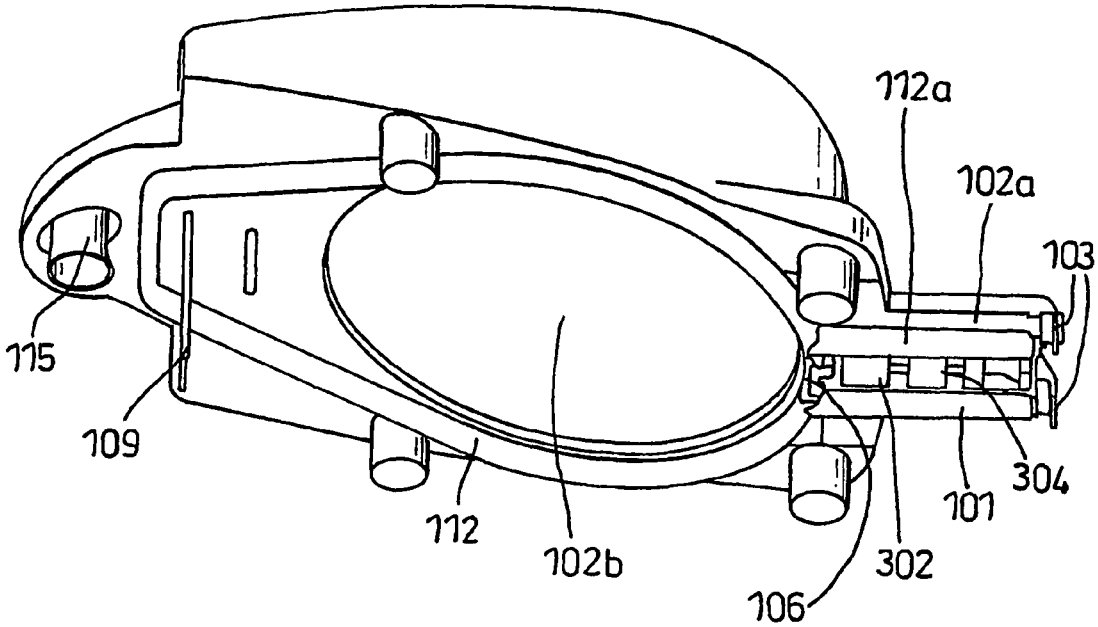
Figure 7A:
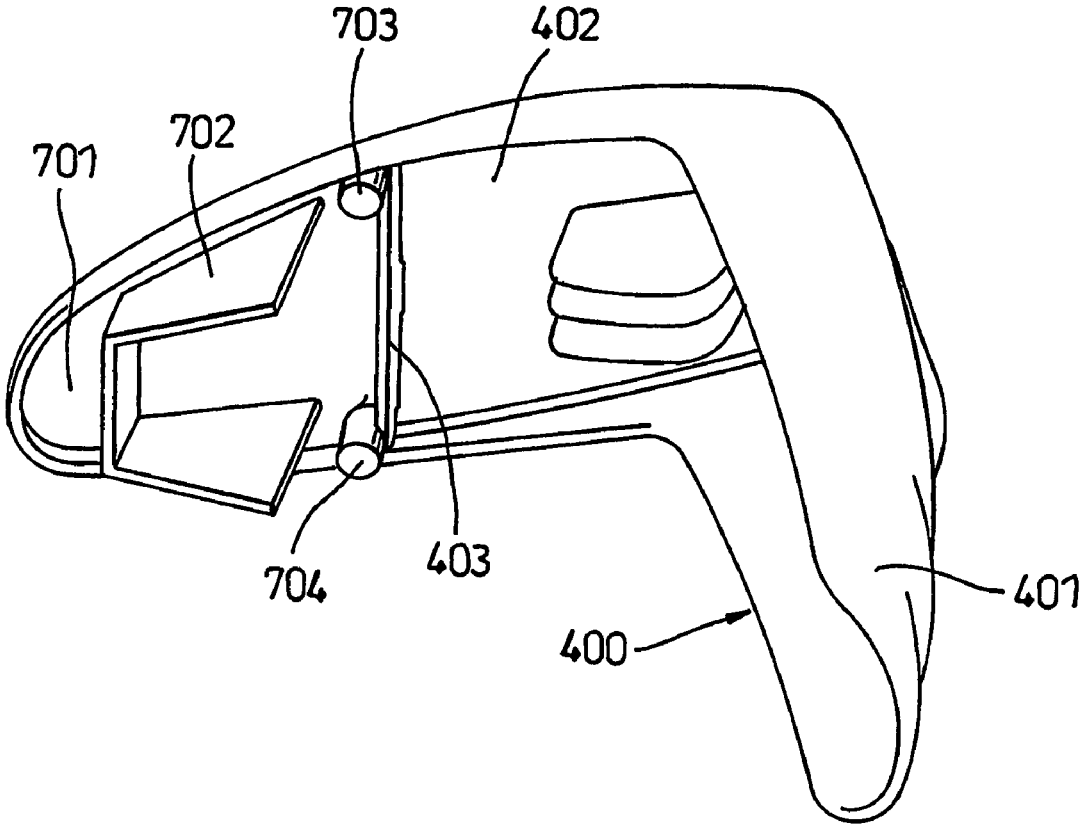
FIGS. 7A and 7B show perspective views of a trigger actuator adapted to be fitted to the base 101 shown in FIGS. 5A and 5B.
Figure 7B:
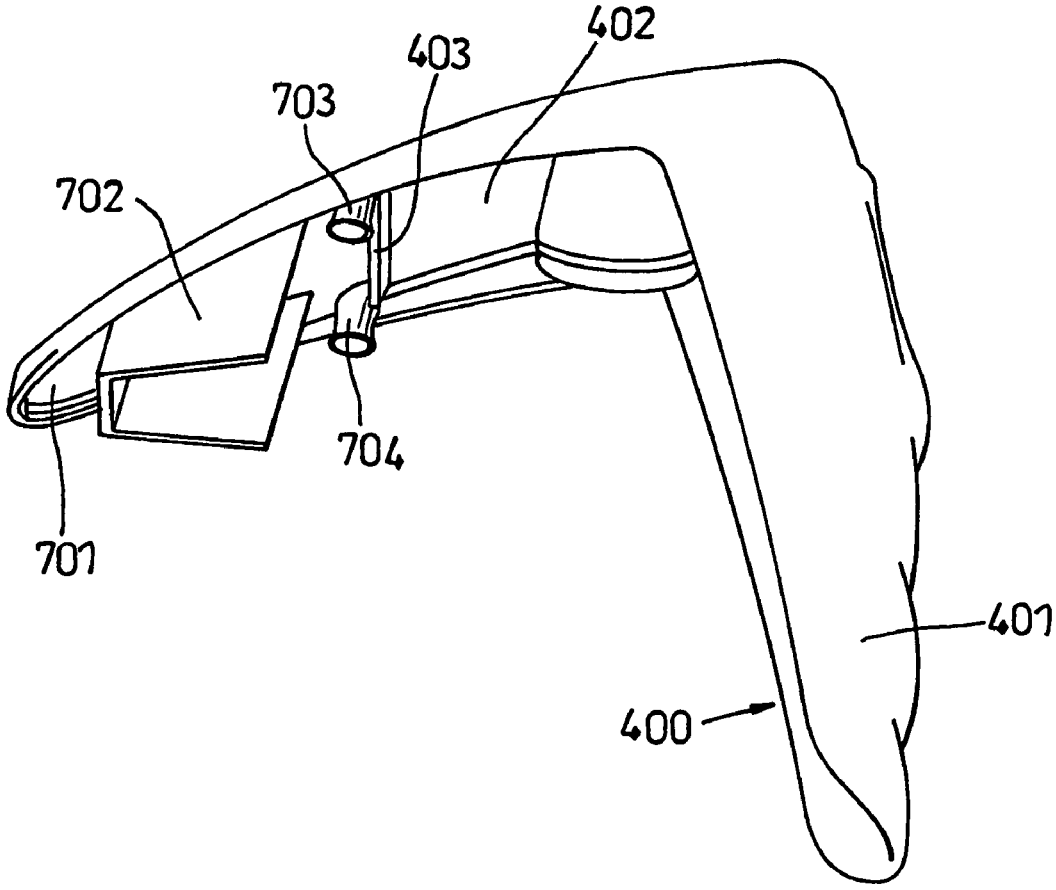

An alternative embodiment of the present invention is shown in FIGS. 5A, 5B, 6A, 6B, 7A and 7B. FIGS. 5A and 5B show perspective views of the base portion 101 of this embodiment of the invention, whereas FIGS. 6A and 6B show perspective views of the upper part 102 and FIGS. 7A and 7B show perspective views of a trigger actuator 400 adapted to be fitted to the base 101.

Referring to FIGS. 5A and 5B, the base 101 comprises a number of features shown and described in reference to previous, figures, as shown by the like reference numerals. In contrast to the previously described embodiments, however, the base 101 comprises a rear cavity 501 and the inlet 108 is elevated relative to the recessed chamber defining portion 101*b* of the upper surface of the base 101. The significance of these and other adaptations to this embodiment will be discussed further below.

Referring to FIGS. 6A and 6B, the upper part 102 is adapted to be fitted to the upper surface of the base 101 shown in FIGS. 5A and 5B. When located onto the base, the upper part 102 covers all of the upper surface of the base 101 except for the rear cavity 501.

As previously discussed, portion 101*b* of the base 101 and the resiliently deformable portion 102*b* of the upper part 102 form the walls that define the chamber of the device when the upper part 102 is fitted to the base 101. In contrast to the previously described embodiment of the invention, however, the portions 102*b* and 101*b* are both much shallower and generally flatter in profile. This results in the formation of chamber in which the resiliently deformable wall formed by portion 102*b* of the upper part 102 only need to be deformed a small amount to bring into close contact with the surface of the opposing wall formed by portion 101*b* of the base 101, thereby increasing the ease with which the chamber can be compressed. Hence, the amount of dead space remaining after the portion 102*b* is deformed will also be reduced and the overall efficiency of the device is increased.

As previously described, the resiliently deformable flap 109 formed on the upper part 102 fits into the seat 108*a* surrounding the inlet opening 108 and is resiliently biased against the opening 108 so as to form a tight seal therewith. The provision of a lip around the rim of the inlet opening 108 enables a ring seal to be effectively formed and rails 108*b* and 108*c* prevent the flap exerting too much pressure on the lip. The elevated position of the inlet relative to the recessed portion 102*b* also assists by ensuring that liquid present in the chamber during use does not reside directly on the flap valve, thereby reducing the risk that any leakage may occur past the flap valve.

When the upper part 102 and the base 101 are contacted together, the abutment surface of the upper part 102*a* contacts the abutment surface 101*b* of the base 101. Corresponding grooves and recesses formed on the abutment surfaces 101*a* and 102*a* align to define an outlet passageway through which fluid can flow from the chamber to an outlet orifice formed where the grooves meet the edge of the abutment surfaces 101*a* and 102*a*.

The upper part 102 has on its lower surface a resiliently deformable member 115 which, when the upper and lower parts are contacted together, is received in the opening 116 of the base 101 to form the air leak valve, as previously described in reference to FIGS. 1A and 1B.

The upper part 102 is connected to the base by a foldable/bendable connection element 103, which is formed of thin sections of plastic and can bend so as to permit the upper part 102 to be swung into and out of engagement with the base part 101. To prevent the hinge joint urging the two abutment surfaces 102*a* and 101*a* apart due to its inherent resilience when it is bent, it is preferable that each bridge member is configured so that it stretches as it is folded over to bring the upper and lower parts together. This stretching introduces a pretension at the hinge connection element, which, instead of urging the two abutment surfaces apart, in fact urges the opposing abutment surfaces together.

FIGS. 7A and 7B both show perspective views of a trigger actuator 400 adapted to be fitted to the body of the nozzle device formed by connecting the upper part 102 shown in FIGS. 6A and 6B to the base 101 shown in FIGS. 5A and 5B.

As before, the trigger actuator has an engagement portion 402 disposed substantially perpendicular to a handle portion 401. The trigger actuator also comprises a mounting portion 701 with protrusion elements 702, 703 and 704 formed thereon. The mounting portion 701 is adapted to enable the trigger 400 to be connected to the rear cavity 501 of the base 101 and protrusion elements 702, 703 and 704 enable the trigger to enter a retaining engagement with the base 101.

Once in place, the engagement portion of the trigger extends across the resiliently deformable portion of the body and the handle extends downwards over the front face of the device (i.e. the face comprising the outlet through which fluid is ejected), as before.

However, one drawback of the previous embodiment of the invention shown in FIGS. 4A and 4B is that the trigger 400 pivots about the hinge connection 403 at the rear end of the top portion and this means that a person operating the trigger has to pull the trigger downwards as well as inwards towards the dispenser device in order to actuate the dispensing of fluid from the device. In contrast, the alternative embodiment shown in FIGS. 5A, 5B, 6A, 6B, 7A and 7B is configured to pivot between the mounting portion 701 and the engagement portion 402 of the trigger actuator, i.e. along the beam 403 which is disposed at a position along the length of the top of the device, rather than at one thereof. Most preferably, the pivot is formed at or proximate to the middle region of the top of the device.

It has been found that an advantage of the trigger 400 shown in FIGS. 7A and 7B is that the downwardly extending handle portion 401 can be simply pulled towards the body of the dispenser device in the conventional manner to compress the resiliently deformable wall 102*b* of the chamber and eject the fluid stored therein through the outlet as previously described. Thus, the requirement to additionally pull the handle portion downwards to trigger the release of fluid through the outlet is obviated.

Figure 8:
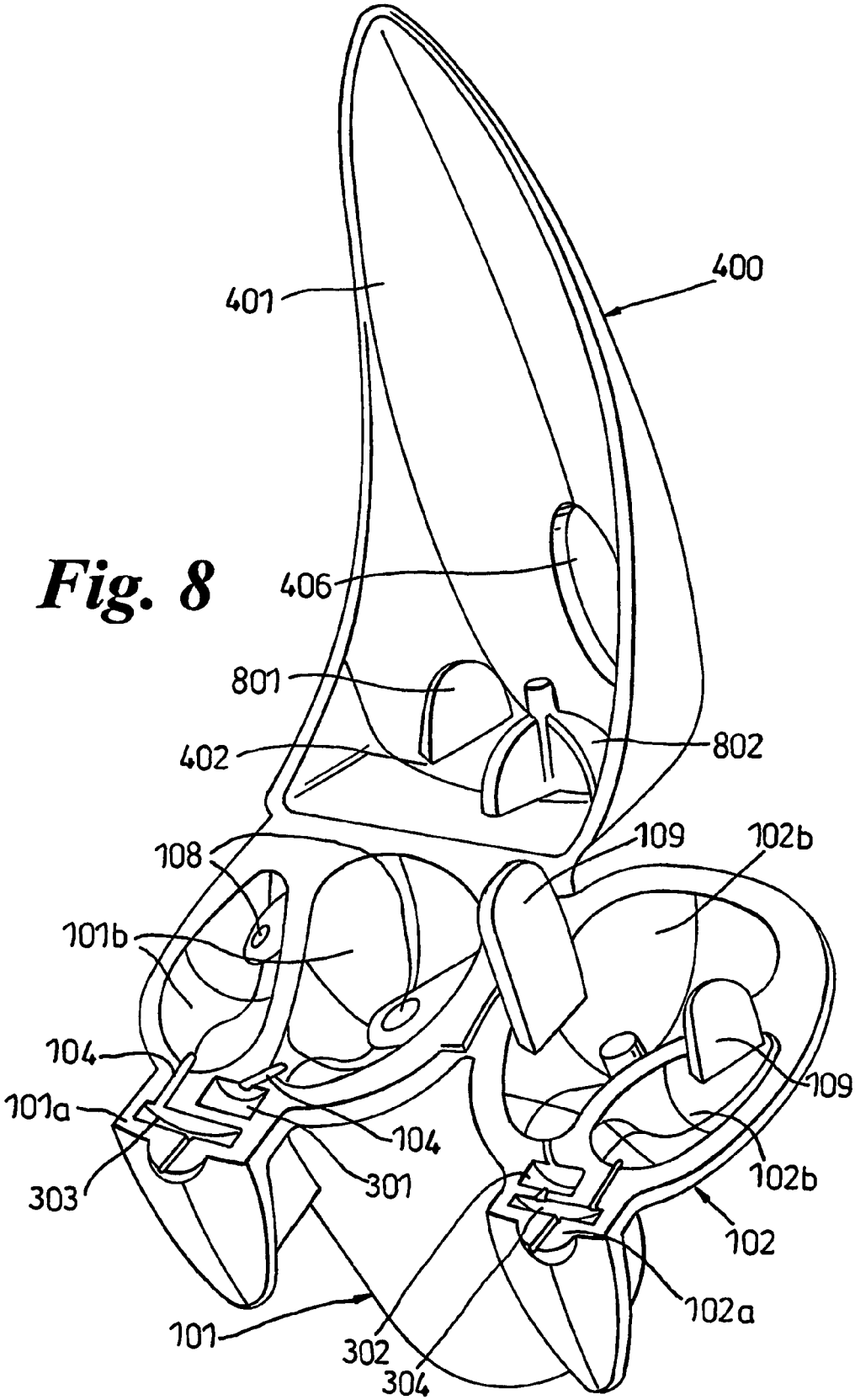
FIG. 8 is a perspective view of a further embodiment of a nozzle arrangement according to the third aspect of the invention in a dissembled configuration.

FIG. 8 shows a further alternative embodiment of the invention, which is similar to that shown in FIGS. 4A and 4B, except that this embodiment comprises two separate chambers formed by dome shaped recesses 102*b* of the upper part 102 and 101*b* of the base 101. Each chamber is provided with its own inlet 108 and its own flap valve formed by flap projections 109. This enables two separate fluids to be drawn into the nozzle arrangement from different compartments within the same container. As in FIGS. 4A and 4B, a an outlet passageway is formed by the abutment of surfaces 102*a* and 101*a*, each of which is provided with recesses 301 to 304 and grooves which align when the surfaces are brought into abutment to define a passageway from each chamber to the outlet orifice. During use, the fluid from one chamber passes through a first expansion chamber and mixes with fluid from the other chamber in the second expansion chamber prior to being ejected through the outlet orifice of the device. In addition, an outlet valve is provided before the outlet passageway network in each chamber to ensure that fluid only travels through the outlet passageway when the requisite pressure in the respective chambers is attained following compression.

The trigger actuator 400 is virtually identical to the trigger actuator shown in FIGS. 4A and 4B. The only adaptation is the provision of two engagement protrusions 801 and 802, to deform the portions 102*b* of each chamber when the trigger handle 401 is pulled.

FIGS. 9A-9G show various views of a further alternative embodiment of the invention. This embodiment is in many respects the same as the embodiment illustrated in FIGS. 5A, 5B, 6A, 6B, 7A and 7B, except that instead of defining a single chamber the device comprises two separate chambers, so as to permit two separate fluids to be ejected together from the device during use. In contrast to the embodiment shown in FIG. 8, however, the fluid ejected from each chamber does not mix within the outlet passageway. Instead, the fluid from each chamber is ejected through separate outlet passageways and outlet orifices.

The equivalence of other features will be apparent from the use of like reference numerals.

One further difference is that the entire device is moulded as a single component part with the upper part 102 and the trigger 400 connected to the base by foldable/bendable connection elements 103, as shown in FIGS. 9C and 9D, and then connected together to form the assembled nozzle device.

Yet another difference is that the trigger handle comprises locking tabs 410, which can be selectively disposed between the trigger handle 401 and the base 101 to prevent the accidental actuation of the device. To release the lock, tabs 410 can be pushed inwards so that the trigger can slide past them when it is pulled. The lock can be rendered child proof by requiring an operator to initially displace the handle forward before the locking tabs 410 can be pushed inwards. Thus, the co-ordination of two actions is required in order to release the lock.

FIG. 10 shows a further alternative embodiment of the invention comprising a base 101, an upper part 102 and a trigger actuator 400 integrally formed with the base 101. In contrast to the previously described embodiments, the upper part 102*b* is not resiliently deformable, but instead defines a piston cylinder 1001 in which a piston 1002 is slidably mounted. The piston is connected to the engagement portion 402 of the trigger actuator and is resiliently biased in the portion shown in FIG. 10. Pulling the trigger handle 401 causes the piston 1002 to be displaced downwards, thereby causing the volume of the chamber to reduce and fluid present therein to be dispensed through the outlet passageway 202. When the trigger handle 401 is released, the piston returns to its resiliently biased position and more fluid is then drawn into the chamber 201 through the inlet.

The embodiment shown in FIG. 10 preferably also comprises the seal, air leak valve, outlet valve and inlet valves described in previous embodiments of the invention.

It shall be appreciated that the description of the embodiments of the invention described in reference to the figures is intended to be by way of example only and should not construed as limiting the scope of the invention.

The invention claimed is:

1. A pump-action nozzle device adapted to be fitted to an opening of a container so as to enable fluid stored in said container to be dispensed, said device having a body which defines an internal chamber, said device also having an inlet through which fluid may be drawn into said chamber and an outlet through which fluid present in the chamber may be expelled from the device, said outlet comprising an outlet orifice and a fluid passageway connecting the chamber with the outlet orifice, said device comprising an inlet valve adapted to only permit fluid to flow into the chamber through the inlet when the pressure within the chamber falls below the pressure within the interior of the container to which the device is attached by at least a predetermined minimum threshold amount and said device comprising an outlet valve configured to only permit fluid to flow out of the chamber and be expelled from the nozzle when the pressure within the chamber exceeds the external pressure at the outlet by at least a predetermined threshold amount, wherein the body includes two parts which between them define the internal chamber and at least part of the outlet passageway, and wherein at least a portion of a first one of the two parts of the body which define said chamber is configured to:

(a) resiliently deform from an initially resilient biased configuration to a distended or deformed configuration in response to the application of a pressure, whereby the volume of said chamber defined by said portion of the body is reduced as said portion of the body is deformed from said initial configuration to said distended or deformed configuration, said reduction in volume causing the pressure within the chamber to increase and fluid to be ejected through the outlet; and (b) subsequently return to its initial resiliently biased configuration when the applied pressure is removed, thereby causing the volume of the chamber to increase and the pressure therein to fall such that fluid is drawn into the chamber through the inlet valve; and characterized in that said deformable portion of the first part of the body is non-planar and generally dome-shaped when in its initial resiliently biased configuration and in that the second of said parts of the body has a non-planar region which defines the internal chamber together with the deformable portion, said nonplanar and generally dome-shaped portion of said first part resiliently deforming and entering a concave region of said second of said parts thereby reducing dead space within said internal chamber, the first of said parts of the body comprising the resiliently deformable portion and a rigid framework integral with the resiliently deformable portion, the rigid framework having a first planar rigid abutment surface surrounding said deformable portion in which the first planar rigid abutment surface of the second of said parts of the body, the second of said rigid abutment surface being located about an outer periphery of the concave region of said second of said parts of the body, the nozzle device further comprising a trigger actuator having a trigger handle that is adapted to be pulled by an operator to actuate the device and an engagement portion configured to engage said deformable portion and cause it to deform from its resiliently biased position towards the non-planar region of the second of said parts of the body when said trigger handle is pulled.

2. A pump action nozzle device according to claim 1, wherein the trigger handle is pivoted on the upper surface of the nozzle device, above an upper face of the body, and has a part extending across said resiliently deformable or displaceable portion and bearing thereon to resiliently deform or displace said portion when the trigger handle is actuated, and the handle having a part for manipulation which extends below and in front of the body of the nozzle device, and an engagement portion configured to engage said portion of the body and cause it to deform from its resiliently biased position when said trigger handle is pulled.

3. A nozzle device according to claim 1, wherein the body comprises a base part and an upper part, and said chamber or chambers is or are at least partly defined by a hollowed out part or concavity in either or both of said parts.

4. A nozzle device according to claim 1, wherein the deformable portion makes up at least part of the surface of the body of the device.

5. A nozzle device according to claim 1, wherein the deformable portion is on one side of the device.

6. A nozzle device according to claim 1, wherein the deformable portion is below the device.

7. A nozzle device according to claim 1, wherein the device comprises less than six component parts.

8. A nozzle device according to claim 1, wherein the device comprises no more than three component parts.

9. A nozzle device according to claim 1, wherein the device comprises two component parts.

10. A nozzle device according to claim 1, wherein the device comprises a single component part.

11. A nozzle device according to claim 1, wherein the trigger actuator is a separate component that is configured to be fitted to the body of the nozzle device.

12. A nozzle device according to claim 1, wherein the trigger is integrally formed with the nozzle device.

13. A nozzle device according to preceding claim 1, wherein the trigger actuator is pivotally mounted to the body of the nozzle device such that pulling the trigger handle causes the engagement portion to be displaced about the pivot and apply pressure to the resiliently deformable portion of the body of the nozzle device.

14. A nozzle device according to claim 13, wherein the trigger actuator is adapted to pivot about an edge of the upper surface of the nozzle device.

15. A nozzle device according to claim 13, wherein the trigger actuator is adapted to pivot at a position proximate to the middle of the upper surface of the nozzle device.

16. A nozzle device according to claim 1, wherein the trigger actuator is integrally formed with the body.

17. A nozzle device according to claim 16, wherein said trigger actuator is connected to the body of the device by a foldable connection element and is configured to pivot about the connection element to enable said portion of the body to be deformed.

18. A nozzle device according to claim 1, wherein said nozzle is integrally formed with said container so as to enable fluid stored in said container to be dispensed during use.

19. A nozzle device according to claim 1, wherein one of said parts of the body is a base part and other of said parts is an upper part.

20. A nozzle arrangement according to claim 19, wherein the upper part comprises said generally dome-shaped resiliently deformable portion of the body that defines the chamber including a flattened dome upper part.

21. A nozzle device according to claim 1, wherein one or more of the inlet, inlet valve, outlet, outlet valve, and chamber and air release valve are all defined by the body.

22. A nozzle device according to claim 1, wherein the nozzle device comprises a locking means configured to prevent fluid being dispensed accidentally.

23. A nozzle device according to claim 22, wherein the lock is integrally formed with the body.

24. A nozzle device according to claim 1, wherein the device further comprises an air leak valve through which air can flow to equalize any pressure differential between the interior of the container and the external environment, but prevents any fluid leaking out of the container if it is inverted.

25. A nozzle device according to claim 1, wherein said device is adapted to dispense a bolus of liquid at its outlet.

26. A nozzle device according to claim 1, wherein said outlet of the said device is adapted to dispense a fluid in the form of a spray.

27. A nozzle device according to claim 26, wherein the outlet passageway comprises two or more internal spray-modifying features disposed before a final spray orifice or a swirl chamber configured to reduce the size of the liquid droplets dispensed through the outlet orifice of the nozzle device during use.

28. A nozzle device according to claim 27, wherein the internal spray-modifying features comprise two or more expansion chambers.

29. A nozzle device according to claim 27, wherein the internal spray-modifying features comprise two or more multiple spray orifices or throttles.

30. A nozzle device according to claim 27, wherein the internal spray-modifying features comprise one or two swirl chambers.

31. A nozzle device according to claim 27, wherein the internal spray-modifying features comprise three or more swirl chambers.

32. A nozzle device according to claim 27, wherein the internal spray-modifying features comprise two internal spray orifices.

33. A nozzle device according to claim 32, wherein the internal spray-modifying features comprise three or more internal spray orifices.

34. A nozzle device according to claim 27, wherein the internal spray-modifying features include one or more venturis.

35. A nozzle device according to claim 27, wherein part of the outlet passageway and outlet orifice are in the form of a separate unit or insert, which is connected to the outlet of the chamber to form the outlet of the nozzle device.

36. A nozzle device according to claim 35, wherein said insert is connected to the body of the device by a hinge so as to enable it to be optionally swung into the required position for use and swing out of position when it is not required.

37. A nozzle device according to claim 1, wherein said portion of the body that can be displaced is a piston mounted within a piston cylinder.

38. A nozzle device according to claim 1, wherein said portion of the body is in the form of a bellows.

39. A nozzle device according to claim 1, wherein at least some of the parts of the device are made from materials which are compatible for welding.

40. A nozzle device according to claim 1, wherein the outlet valve is a pre-compression valve which operates as a one-way valve, and which permits fluid to pass only when a threshold pressure has been reached.

41. A nozzle device according to claim 40, wherein the outlet valve is formed integrally with the body.

42. A nozzle device according to claim 1, wherein the inlet valve comprises a flap valve, comprising a first flap to close the inlet and a second reinforcing flap which acts on the opposite side of the first flap to reinforce the closing actions.

43. A nozzle device according to claim 1, wherein a seal is formed in the body, said seal encompassing the nozzle passageway and the chamber.

44. A container having a pump-action nozzle device according to claim 1, fitted to an opening thereof so as to enable the fluid stored in the container to be dispensed from the container through said nozzle device during use.

45. A container having a pump-action nozzle device according to claim 1, integrally formed therewith so as to enable the fluid stored in the container to be dispensed from the container through said nozzle device during use.

46. A nozzle device according to claim 1, wherein said device comprises at least two component parts for assembly with a snap fit.

47. A nozzle device according to claim 1, wherein said device comprises at least two component parts for assembly by welding.

48. A nozzle device according to claim 1, wherein said device comprises at least two component parts for assembly by means of over molding.

49. A nozzle device according to claim 1, wherein said device comprises at least one component part formed by injection molding, and wherein a blowing agent is incorporated into a mold together with a plastic material.

50. A nozzle device according to claim 1, wherein said device comprises at least one component part formed from at least two plastic materials using bi-injection molding.

51. A nozzle device according to claim 50, wherein the at least one component part comprises a base portion formed by means of a bi-injection molding process in which a rigid material is injected into a mold in a first stage and a second relatively flexible material is over molded onto the rigid material in a second stage of the process.

* * * * *